US012215711B1

(12) United States Patent
Harlan et al.

(10) Patent No.: US 12,215,711 B1
(45) Date of Patent: Feb. 4, 2025

(54) CARWASH VACUUM MOTOR

(71) Applicant: VACUUM TECHNOLOGIES, LLC, Sheridan, WY (US)

(72) Inventors: James Jolly Harlan, Banner, WY (US); Jared Leroy Meacham, Sheridan, WY (US); Clay D. Price, Sheridan, WY (US); John F. Tucker, Sheridan, WY (US); Justin Taylor Heaps, Ranchester, WY (US)

(73) Assignee: Vacuum Technologies, LLC, Sheridan, WY (US)

( * ) Notice: Subject to any disclaimer, the term of this patent is extended or adjusted under 35 U.S.C. 154(b) by 0 days.

(21) Appl. No.: 18/404,621

(22) Filed: Jan. 4, 2024

(51) Int. Cl.

| | |
|---|---|
| ***F04D 29/42*** | (2006.01) |
| ***F04D 17/06*** | (2006.01) |
| ***F04D 27/02*** | (2006.01) |
| ***F04D 29/28*** | (2006.01) |

(52) U.S. Cl.
CPC ..... *F04D 29/4206* (2013.01); *F04D 17/06* (2013.01); *F04D 29/281* (2013.01); *F04D 27/0276* (2013.01)

(58) Field of Classification Search
CPC ..... F04D 17/06; F04D 29/2216; F04D 29/28; F04D 29/281; F04D 29/40; F04D 29/42; F04D 29/4206; F04D 29/62; F04D 29/624; F04D 29/626
See application file for complete search history.

(56) References Cited

U.S. PATENT DOCUMENTS

2018/0372116 A1* 12/2018 Nandagopal ..... F04D 29/624
2021/0095691 A1* 4/2021 Yanagisawa ..... F04D 29/624

* cited by examiner

*Primary Examiner* — Elton K Wong
(74) *Attorney, Agent, or Firm* — Nyemaster Goode P.C.

(57) ABSTRACT

A vacuum motor assembly that includes a motor comprising a drive shaft; an impeller having a plurality of impeller blades spaced radially around a center portion of the impeller. An impeller cover that forms an air channel is spaced around the impeller and the impeller cover includes a front portion; a back portion engaged to the front portion; and a back support. The drive shaft of the motor passes through the drive shaft receiving hole of the back support and engages with the impeller. A front surface of the impeller defines a vertical plane and a first air channel interior distance from the front portion inner surface to the vertical plane within the airflow channel is greater than a second air channel interior distance measured from a back portion inner surface to the same vertical plane.

20 Claims, 30 Drawing Sheets

CARWASH VACUUM MOTOR

BACKGROUND

Car wash facilities often include vacuum systems that patrons of the car wash may use to vacuum inside of their vehicles, individual canister vacuum systems located adjacent to the location where a vehicle may be vacuumed are sometimes employed. Also, systems are sometimes employed that use a central vacuum system providing vacuum forced air from a location remote from the vehicle location such as in a facility central building to the individual vehicle vacuuming bays. In such instances where the main vacuum supply motor of the facility is located in a central facility, the facility may sometimes employ a long main vacuum line to provide vacuum suction to numerous vacuuming locations at the facility. These systems generally employ a vacuum system with enough overall suction capacity to provide service to all of the vehicle vacuuming locations even though it is rare that all of the vehicle vacuuming locations are used simultaneously. A larger than typically needed overall suction capacity is required even if all locations are not in use. In fact, multiple vacuum motors are often used to produce the necessary suction. Moreover, these large sized vacuum motors, as all mechanical systems, eventually become damaged or worn and will need repairs or replacement parts. However, vacuum motors currently employed use multiple impellers to create the amount of vacuum capacity necessary to service all of the multiple vehicle vacuuming service locations of the overall vehicle vacuuming facility. The multiple impellers of the vacuum system historically employed were also integrally formed with the motor and the overall system was large and heavy. These factors each contributed to the fact that the prior systems could not be reliably and/or economically taken apart and field serviced at the vehicle vacuuming facility where the vacuum service was being provided to the end customer/user. Instead, the entire vacuum motor system, virtually in every instance, needed to be shipped back to a manufacturer's repair shop. This is costly and inefficient for the owner of the vehicle vacuuming facility and the manufacturer. The potential economic loss due to the down time of the overall vacuum facility that would result if the motor was not present often resulted in the owner or the supplier providing a redundant system while the damaged system was off-site being repaired.

Another drawback of prior systems was the need to provide multiple impellers to provide the necessary airflow/vacuuming capacity to adequately supply vacuum force to each location in the vehicle vacuuming facility in the event that all locations within the facility were in use. Unfortunately, the use of multiple impellers has significant and profound drawbacks. The impellers often had resonance issues and vibrated creating significantly loud volume noise in the main facility housing the vacuuming motor system. Moreover, due to the vibration and the use of multiple components, the systems were more likely to be damaged or need service.

An additional drawback of prior systems was the requirements needed to maintain an equal amount of airflow/vacuuming capacity without increasing the power when the system is in use at facilities at higher and higher elevations above sea level. As the height from sea level increases, the air becomes thinner, and the air pressure decreases. Typically, the systems at higher altitudes would employ a thicker impeller to draw in more air without needing to increase the power of the motor. However, multiple sizes of impellers would need to be produced, making it less economical and more difficult to service since different parts would be necessary for different geographical locations based on the height above sea level as one of the major factors. If a manufacturer wanted to cast their impellers as a singular piece, which makes the impeller stronger and less liable to break, they needed to have multiple molds for various elevations. Alternatively, multiple impellers can be used in sequence, but as stated above, these impellers can have issues with resonance, increasing their vibration and leading to significantly louder use volumes/increased noise and greater potential for damage and earlier damage in the use cycle. The increased likelihood of repair and the need for specialized vacuum motor systems at specific and niche elevation use cases makes this kind of implementation undesirable.

SUMMARY

An aspect of the present disclosure includes a vacuum motor assembly for providing vacuum suction power to one or more vehicle vacuuming locations in a vehicle washing and vacuuming facility. The vacuum motor assembly typically includes: a motor having a drive shaft; an impeller, typically a closed impeller having a front shroud and a back shroud with a plurality of impeller blades spaced radially around a center portion of the closed impeller between the front shroud and the back shroud where the closed impeller has an impeller diameter and where the center portion is free of any of the plurality of impeller blades and the plurality of impeller blades are circumjacent the center portion of the closed impeller; and an impeller cover. The impeller cover is spaced around the closed impeller and includes: a front portion having a front portion central opening defined by an inner perimeter edge, a front portion inner surface, a forwardly extended enlarged channel section between the inner perimeter edge and a front portion outer perimeter edge, where the front portion outer perimeter edge extends away from the front portion inner surface toward the closed impeller, and a front portion air exhaust chute section that is tapered; a back portion engaged to the front portion, where the back portion has front portion facing side and a back support facing side, a back portion inner surface, a back portion air exhaust chute section that matingly engages the front portion air exhaust chute section and is tapered, an interior edge having an interior edge perimeter that defines a back portion opening that is larger than the closed impeller, and an outer perimeter edge engaged with the front portion outer perimeter edge to collectively form a spiral-shaped airflow channel located about a perimeter of the impeller cover, where the spiral-shaped airflow channel starts with a tapered end, extends around the impeller cover, and then into an air exhaust outlet formed by the engagement of the front portion air exhaust chute section and the back portion air exhaust chute section together. A cross-sectional area of the spiral-shaped airflow channel between the front portion and the back portion typically increases from the tapered end to the air exhaust outlet. The front surface of the front shroud of the closed impeller defines a vertical plane and a first air channel interior distance from the front portion inner surface to the vertical plane within the spiral-shaped airflow channel is greater than a second air channel interior distance from the back portion inner surface to the vertical plane. The vacuum motor assembly further typically includes a back support having a back support perimeter, a concave side and a convex side. The concave side of the back support is typically engaged with the back support facing side of the back portion around the back portion opening such that the back support covers substantially all of the back portion opening. The convex side is typically engaged with the motor. The back support also includes a drive shaft receiving aperture portion is fixedly engaged to the motor and the drive shaft passes through the drive shaft receiving aperture of the back support and engages with the closed impeller.

Another aspect of the present disclosure includes a vacuum motor assembly that includes: a motor having a drive shaft; an impeller having a plurality of impeller blades spaced radially around a center portion of the impeller where the impeller has an impeller diameter and typically the center portion that is free of any of the plurality of impeller blades and the plurality of impeller blades are circumjacent the center portion of the impeller; an impeller cover spaced around the impeller; and a back support. The impeller cover typically includes: a front portion having a front portion central opening defined by an inner perimeter edge; a front portion inner surface; a forwardly extended enlarged channel section between the inner perimeter edge and a front portion outer perimeter edge, where the front portion outer perimeter edge extends away from the front portion inner surface toward the impeller; and a front portion air exhaust chute section; a back portion engaged to the front portion, where the back portion has front portion facing side and a back support facing side, a back portion inner surface, a back portion air exhaust chute section, an interior edge having an interior edge perimeter that defines a back portion opening that is larger than the impeller, and an outer perimeter edge engaged with the front portion outer perimeter edge to collectively form an airflow channel that is typically spiral-shaped and located about a perimeter of the impeller cover. The typically spiral-shaped airflow channel starts with a tapered end, extends around the impeller cover, and then into an air exhaust outlet formed by the engagement of the front portion air exhaust chute section and the back portion air exhaust chute section together. The impeller is typically positioned within the impeller cover toward the motor and not in the center of the airflow channel. Typically, the impeller is positioned such that the front surface of the impeller defines a vertical plane and a first air channel interior distance from the front portion inner surface to the vertical plane within the airflow channel is greater than a second air channel interior distance from the back portion inner surface to the vertical plane. The back support typically has a back support perimeter, a motor-facing side and an impeller-facing side. The impeller-facing side of the back support is engaged with the back support facing side of the back portion around the back portion opening such that the back support covers the back portion opening. The motor-facing side is engaged with the motor during use. The back support further typically includes a drive shaft receiving aperture. When the back support is fixedly engaged to the motor the drive shaft passes through the drive shaft receiving aperture of the back support and engages with the impeller so that the motor rotates the impeller during use.

Yet another aspect of the present disclosure includes a method of replacing a component of a vacuum motor assembly without removing an impeller of the vacuum motor assembly from engagement with an impeller, the method typically includes the steps of: disengaging a first back support from engagement with a first impeller cover spaced around the impeller. The first impeller cover typically includes: a front portion having a front portion central opening defined by an inner perimeter edge; a front portion inner surface; a forwardly extended enlarged channel section between the inner perimeter edge and a front portion outer perimeter edge and a front portion air exhaust chute section. The front portion outer perimeter edge extends away from the front portion inner surface toward the impeller; a back portion engaged to the front portion, where the back portion has front portion facing side and a back support facing side, a back portion inner surface, a back portion air exhaust chute section, an interior edge having an interior edge perimeter that defines a back portion opening, and an outer perimeter edge engaged with the front portion outer perimeter edge to collectively form an airflow channel that is typically a spiral-shaped airflow channel located about a perimeter of the first impeller cover, where the airflow channel starts with a tapered end, extends around the first impeller cover, and then into an air exhaust outlet formed by the engagement of the front portion air exhaust chute section and the back portion air exhaust chute section together. The first back support has a first back support perimeter, a motor-facing side and an impeller-facing side, where the impeller-facing side of the first back support is engaged with the back support facing side of the back portion around the back portion opening such that the first back support covers the back portion opening of the first impeller cover, and where the motor-facing side is engaged with a motor, where the first back support further typically includes a drive shaft receiving aperture. When the first back support is fixedly engaged to the motor, the drive shaft of the motor passes through the drive shaft receiving aperture of the back support and engages with the impeller that is positioned between within the first impeller cover and the motor provides rotational force to the impeller during use. The method further comprises the step of replacing either or both of (1) all or a portion of the first impeller cover with all or a portion of a second impeller cover or (2) the first back support with a second back support, typically after a period of time of use that can by at least months or years and after they are worn or broken. The second impeller cover typically includes: a front portion having a front portion central opening defined by an inner perimeter edge; a front portion inner surface; a forwardly extended enlarged channel section between the inner perimeter edge and a front portion outer perimeter edge, where the front portion outer perimeter edge extends away from the front portion inner surface toward the impeller; and a front portion air exhaust chute section; a back portion engaged to the front portion, where the back portion has front portion facing side and a back support facing side, a back portion inner surface, a back portion air exhaust chute section, an interior edge having an interior edge perimeter that defines a back portion opening, and an outer perimeter edge engaged with the front portion outer perimeter edge to collectively form an airflow channel that is typically a spiral-shaped airflow channel located about a perimeter of the first impeller cover, where the airflow channel typically starts with a tapered end, extends around the first impeller cover, and then into an air exhaust outlet formed by the engagement of the front portion air exhaust chute section and the back portion air exhaust chute section together. The second back support has a second back support perimeter, a motor-facing side and an impeller-facing side, where the impeller-facing side of the second back support is engaged with the back support facing side of the back portion around the back portion opening such that the back support covers the back portion opening, and where the motor-facing side is engaged with a motor. The first back support further typically includes a drive shaft receiving aperture; and, when the first back support is fixedly engaged to the motor, a drive shaft of the motor passes through the drive shaft receiving aperture of the back support and engages with the impeller that is positioned between within the second impeller cover.

Yet another aspect of the present disclosure includes a kit having a motor assembly of the present disclosure and a high elevation kit/system of the present disclosure and optionally also a replacement impeller cover of the present disclosure. The kit may also include a motor assembly or multiple motor assemblies of the present disclosure and one or a plurality of replacement impeller covers that are typically identical to the impeller covers originally provided with the motor assembly or multiple motor assemblies.

These and other aspects, objects, and features of the present disclosure and claimed invention will be understood and appreciated by those skilled in the art upon studying the following specification, claims, and appended drawings.

DETAILED DESCRIPTION

Figure 2:
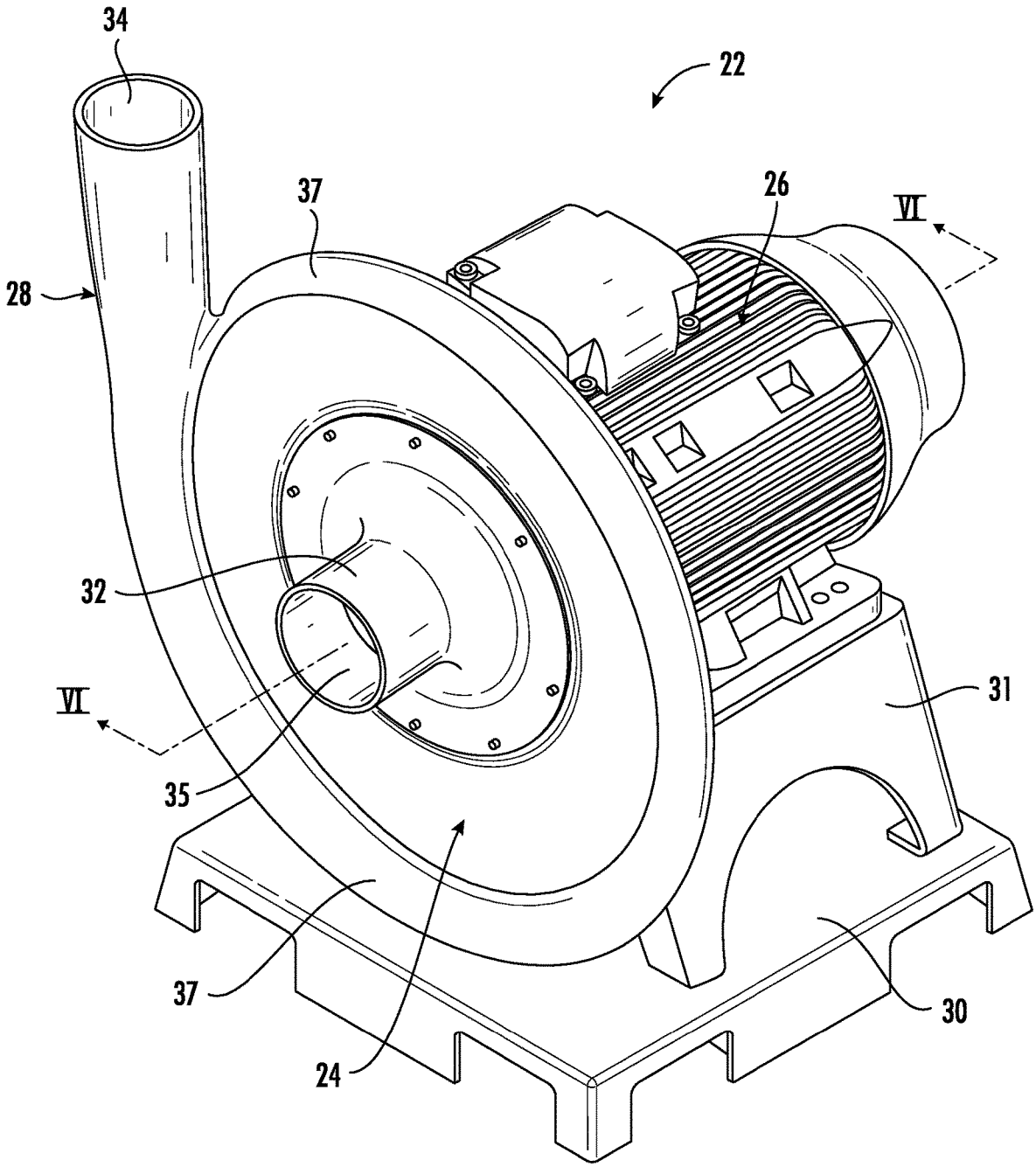
FIG. 2 is a front perspective view of the vacuum motor assembly according to an aspect of the present disclosure.
Figure 3:
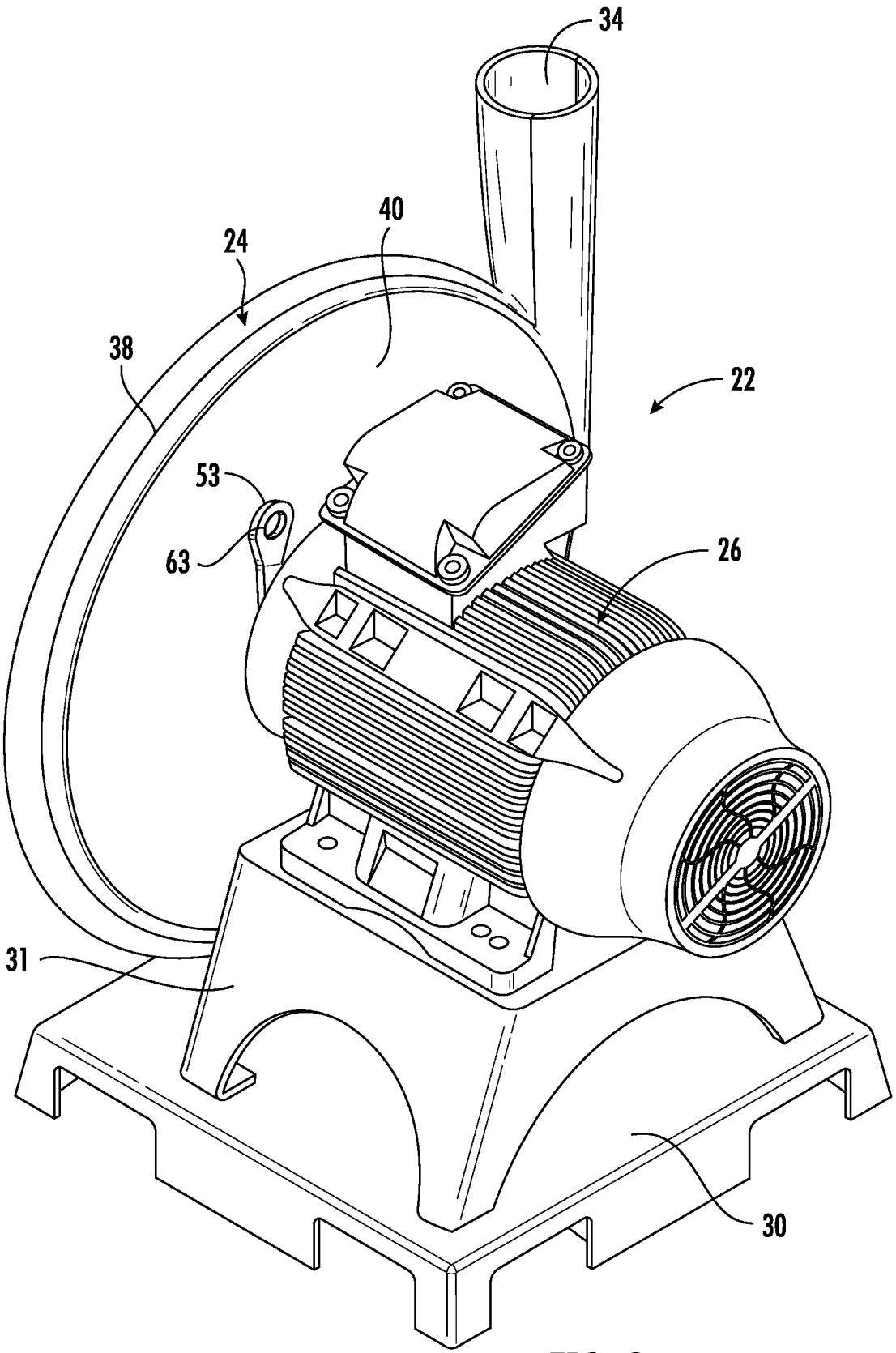
FIG. 3 is a rear perspective view of the vacuum motor assembly according to an aspect of the present disclosure.

For purposes of description herein, the terms "upper," "lower," "right," "left," "rear," "front," "vertical," "horizontal," and derivatives thereof shall relate to the invention as oriented in FIG. 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

It will be understood by one having ordinary skill in the art that construction of the described invention and other components is not limited to any specific material. Other exemplary embodiments of the invention disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

The term "about" in the context of the present application means a range of values inclusive of the specified value that a person skilled in the art would reasonably consider to be comparable to the specified value. In certain aspects of the present disclosure, "about" means within a standard deviation using measurements generally accepted in the art. In other aspects of the present disclosure, "about" will mean the specified value but ranging up to ±10% of the specified value.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

It is also to be understood that variations and modifications can be made on the aforementioned structures and methods without departing from the concepts of the present disclosure and claimed invention, and further it is to be understood that such concepts are intended to be covered by the following claims unless these claims by their language expressly state otherwise.

It is to be understood that the disclosed innovations may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise. Where a range of values is provided, it is understood that each intervening value, to the tenth of the unit of the lower limit unless the context clearly dictates otherwise, between the upper and lower limit of that range, and any other stated or intervening value in that stated range, is encompassed within the scope of the present disclosure. The upper and lower limits of these smaller ranges may independently be included in the smaller ranges, and are also encompassed within the scope of the present disclosure, subject to any specifically excluded limit in the stated range. Where the stated range includes one or both of the limits, ranges excluding either or both of those included limits are also included in the scope of the present disclosure. All ranges and parameters, including but not limited to percentages, parts, and ratios, disclosed herein are understood to encompass any and all sub-ranges assumed and subsumed therein, and every number between the endpoints. For example, a stated range of "1 to 10" should be considered to include any and all sub-ranges beginning with a minimum value of 1 or more and ending with a maximum value of 10 or less (e.g., 1 to 6.1, or 2.3 to 9.4), and to each integer (1, 2, 3, 4, 5, 6, 7, 8, 9, 10) contained within the range. In this specification and the appended claims, the singular forms "a," "an" and "the" include plural reference unless the context clearly dictates otherwise. All combinations of method steps or process steps as used herein can be performed in any order, unless otherwise specified or clearly implied to the contrary by the context in which the referenced combination is made.

To the extent that the terms "includes" or "including" or "have" or "having" are used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A" or "B" or both "A" and "B". When the Applicant intends to indicate "only A or B but not both" then the term "only A or B but not both" or similar structure will be employed. Thus, use of the term "or" herein is the inclusive, and not the exclusive use. Also, to the extent that the terms "in" or "into" are used in the specification or the claims, it is intended to additionally mean "on" or "onto." In this specification and the appended claims, the singular forms "a," "an" and "the" include plural reference unless the context clearly dictates otherwise.

Figure 1A:
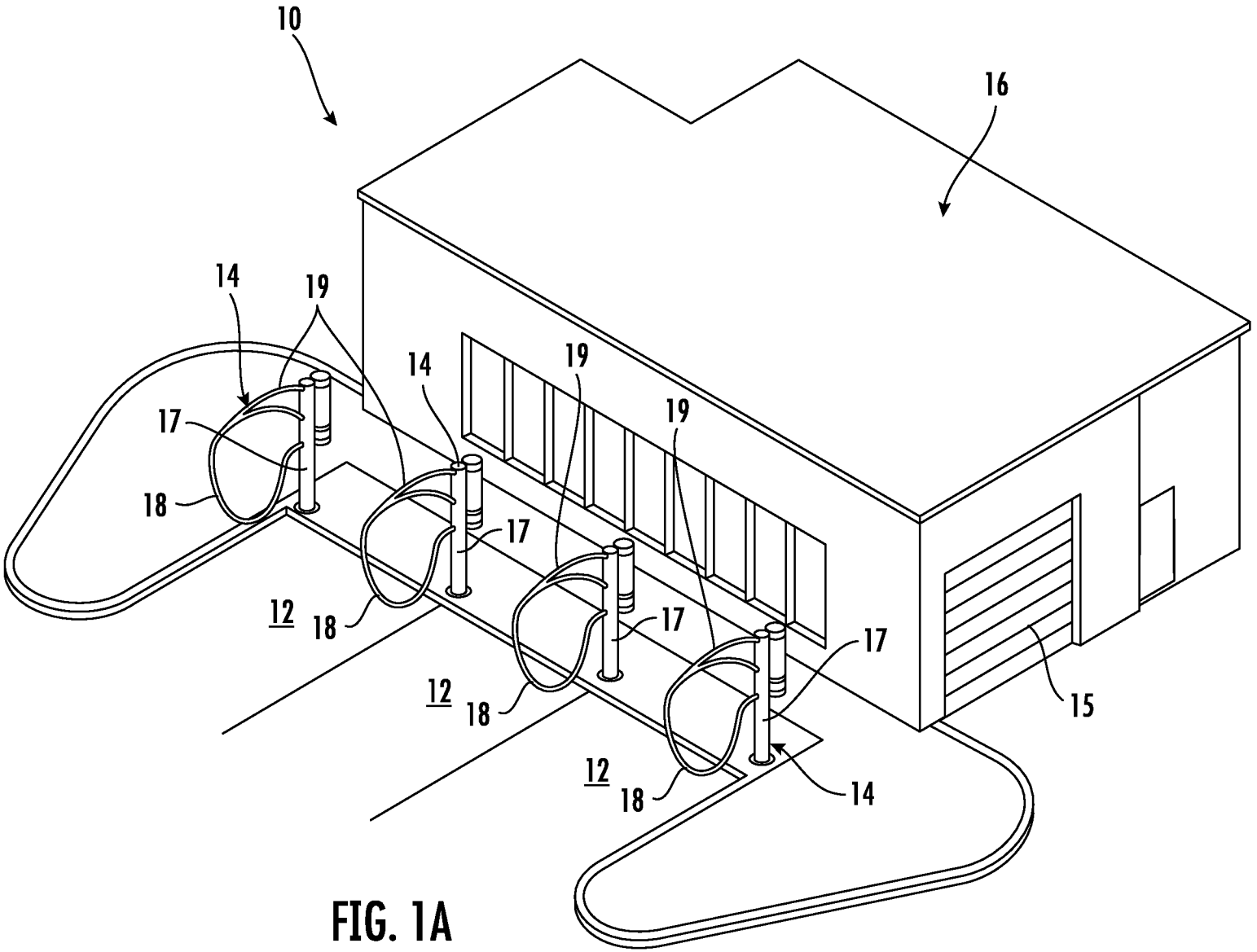
FIG. 1A is perspective view of an exemplary car wash facility and its related vacuum system(s) and shows the building and vacuum systems where the main vacuum line is underground and not shown while nevertheless shared across each of the vacuum stalls/vehicle vacuuming locations.

FIG. 1A generally displays an overall vehicle treatment facility 10 in which a vacuum motor assembly 22 of the present disclosure may be used to provide vacuum force/power to a plurality of locations simultaneously or one location as well if only one vacuum stall 12 is in use. The vehicle treatment facility may include a door 15 that opens when a vehicle enters the vehicle washing portion of the vehicle treatment facility. The vacuum motor assembly 22 of the present disclosure is typically positioned inside a portion of the main building 16 at the vehicle treatment facility and is typically positioned in a portion of the main building or a separate enclosure/building from the vehicle treatment facility such that it is separated from the washing portion of the facility but still enclosed and protected in order to protect it from weather and other environmental factors. The vacuum motor assemblies of the present disclosure provide vacuum force/power for each of at least one, but typically a plurality of, vacuum subsystem 14 that are each associated with at least one vacuum stall 12. A user of the vehicle treatment facility is able to park their vehicle in the vacuum stall 12, and use the vacuum subsystem 14 to clean the inside of their vehicle.

Figure 1B:
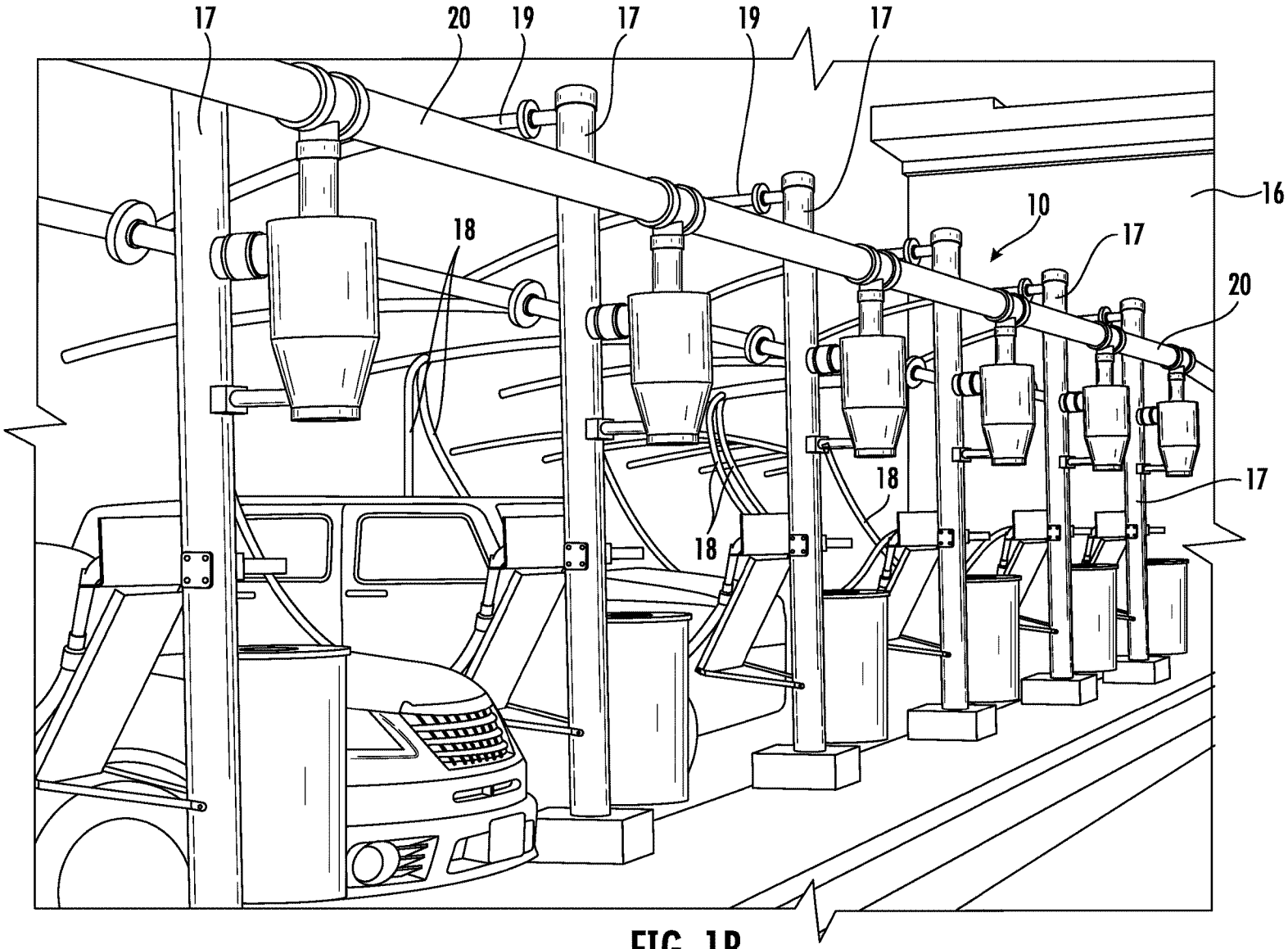
FIG. 1B is a partial perspective view of the vacuum system(s) and stalls of an exemplary vacuum system of a car wash facility showing an aspect of the disclosure where the main vacuum line supplying vacuum to each of the individual stalls is above ground.

The vacuum subsystems 14 are each interconnected to a main vacuum line 20 that is operable engaged with the vacuum motor assembly 22. The vacuum subsystems 14 each typically include a vertical support pole 17, an arch 19 that extends from the top of the vertical support pole 17 above the vacuum stall 12, and a hose 18 that hangs down from the arch 19 such that a user can manipulate the hose 18 without it dragging across the ground. Each of the systems may include a cyclonic separator 21 positioned between the hose and the main vacuum line. Each vacuum system's hose 18 attaches to a main vacuum line 20 either directly or indirectly through a cyclonic separator (See FIG. 1B), which is in turn, attached to a vacuum motor assembly 22, which provides vacuum power using a motor 26. In FIG. 1A, the vacuum hoses 18 and the main vacuum line 20 run underground, and are therefore not visible in the figure. The main vacuum line 20 can be located underground or above ground. In FIG. 1B, the main vacuum line 20 is positioned above the ground. Due to the amount of airflow that can be produced by the vacuum motor assembly 22, only a single unit needs to be used to run every vacuum system at the facility without the use of additional vacuum motor assemblies. The vacuum motor assembly 22 will typically be sized to provide the necessary vacuum forces to effectively provide service to every stall of the overall vehicle treatment facility 10 even if each and every hose 18 is in use simultaneously.

As shown in FIGS. 1-10, the vacuum motor assembly 22 typically includes a motor 26 that is typically, but not necessarily, attached to a base 30 and optionally an elevated stand 31, and a vacuum pump assembly 24. The vacuum pump assembly 24 typically includes a back support 40 that is attached to the front end 29 of the motor 26 and a drive shaft 48 can extend from the motor 26 and into the vacuum pump assembly 24. The bottom surface of the motor 26 is typically bolted or otherwise affixed to apertures in the elevated stand that correspond to apertures in a base of the motor. The vacuum pump assembly 24 further typically includes a cover 28 with a front portion 36 and a back portion 38 that is attached to the back support 40. The front portion 36 is typically engaged with the back portion 38 such that there is an internal volume of space between them. The front portion 36 of the cover 28 typically provides a greater portion of the outlet 34 than the back portion 38 when they are matingly engaged to one another during use. The cover 28 typically has an air exhaust chute 41 that has an increasing cross-sectional surface area as the air travels up the air exhaust chute and approaches the outlet 34. This is typically true of the air as it travels through the entire air channel 39, which is generally spirally shaped, to form a larger outlet 34. That is the cross-sectional area of the air channel begins to increase at a certain point in a spiral manner until the air ultimately leaves the air channel out the outlet 34 at the top of the air exhaust chute 41. The air channel 39 starts at a narrow air channel source 43 where the air channel begins and widens as the air channel 39 extends circumferentially around the vacuum pump assembly 24 to the outlet 34, which is the widest point of the air channel 39. While the air driven by the impeller may first enter the air channel at the narrow air channel source 43, air driven by the impeller may enter the air channel at any point around the air channel proximate the impeller due to the rotation of the impeller. The outlet 34 may be engaged with other piping to deliver the air into the atmosphere generally either within the interior of a building structure or deliver the exhaust air to the ambient atmosphere outside of the structure housing the vacuum motor assembly 22. Said another way, the air channel 39 starts narrow with a small cross-sectional area, but the cross-sectional area expands as the air moves along a circular path around the impeller 42 until it reaches the outlet 34. During operation, air is forced into the channel 39 as it is thrown from the impeller 42. The air will enter the air channel 39 at a high speed, but will slow as it travels along the channel 39 into wider cross-sectional areas.

The outlet 34 is typically on the left side of the overall vacuum pump assembly 24 and the cover 28, but the construction could be reversed such that the outlet 34 is on either side. Furthermore, the outlet 34 does not need to be oriented in an upwards direction and could continue in another pass of a portion of or completely around the overall vacuum pump assembly 24 if desired to further slow or redirect the air coming out from the outlet 34. If the outlet 34 is on a different side than shown in the present disclosure, then the impeller 42 would spin in the opposite direction to ensure the airflow follows the correct path and to allow for the creation of a stable airflow thereby preventing or greatly lessening the likelihood of damage to the vacuum pump assembly 24. The outlet 34 may include a top horizontal planar and outwardly extending lip about its perimeter, typically about the entire perimeter or at least 90% of the perimeter surface. The outwardly extending lip may allow for better engagement to other pipe or conduits by snap fitting or being integrated with other piping that provides outlet air to ambient atmosphere outside of the motor assembly, typically outside of the building housing the motor assembly such as an air outlet within a wall or ceiling of a building housing the motor assembly. One or more segments of piping, which can be solid polyvinylpyrrolidone (PVP) or other plastic piping or can be metal or flexible metal or flexible plastic piping running between the outlet of the motor assembly and the outlet of the building housing the motor assembly.

The cover 28 is formed when the front portion 36, the back portion 38 and the back support 40 are assembled together with the impeller 42 spaced therein. The cover 28 has a unique shape that provides multiple advantages. The increased size/diameter of the impeller 42 that is able to fit inside the enlarged cover 28 increases the efficiency of the motor 26 and allows the vacuum motor 26 to move greater volumes of air without changing its horsepower while also using less energy. This also may allow the vacuum systems located remotely from the individual vacuum subsystems 14 to employ motors that are less expensive and provide the same or more vacuum suction power to the overall vehicle vacuum system thereby maintaining vacuum performance of the overall vehicle vacuum system.

The overall vacuum pump assembly 24 typically has a diameter in the range of from about 36.5 inches to about 38.5 inches. The vacuum pump assembly 24 most typically has a diameter of 33 inches or greater, more typically between about 35 inches and about 40 inches in diameter and most typically about 37.5 inches. In the context of the diameter here, the term "about" means within the range where a person skilled in the art would reasonably be consider to be comparable, typically one inch variance in the above amounts.

Figure 4:
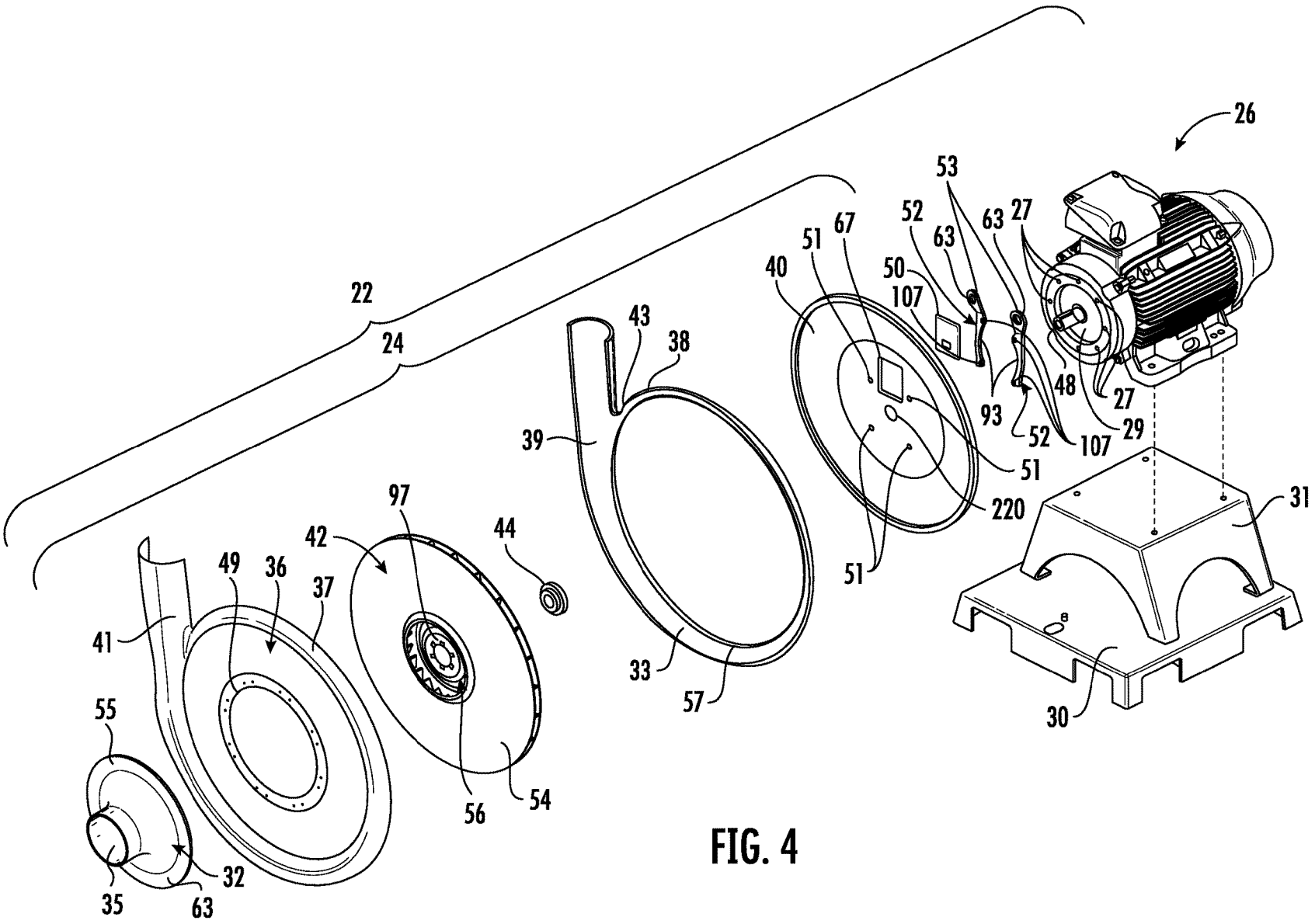
FIG. 4 is a front exploded view of the vacuum motor assembly with the cover separated into its front and back halves according to an aspect of the present disclosure.
Figure 5:
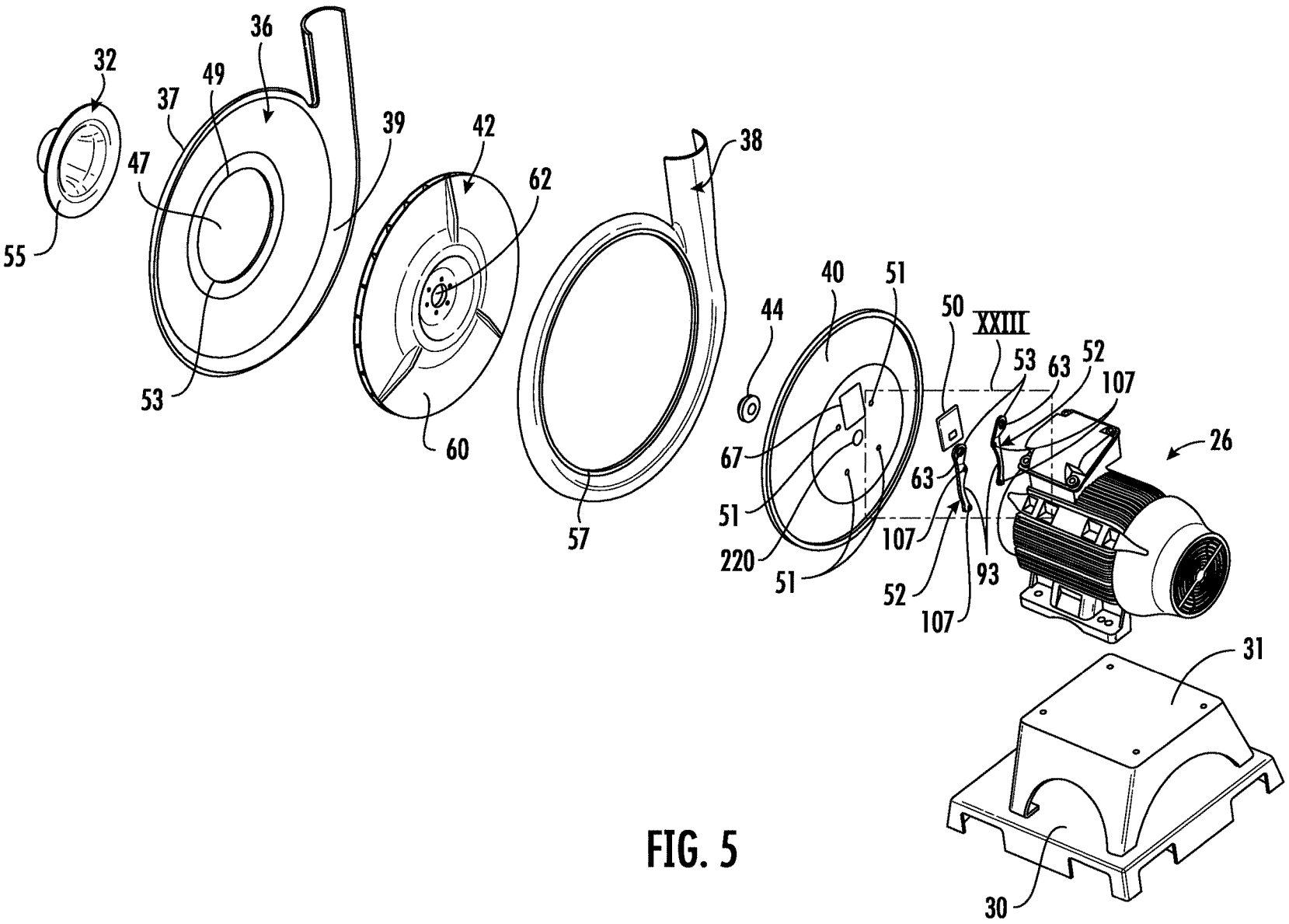
FIG. 5 is a is a rear exploded view of the vacuum motor assembly with the cover separated into its front and back halves according to an aspect of the present disclosure.
Figure 6:
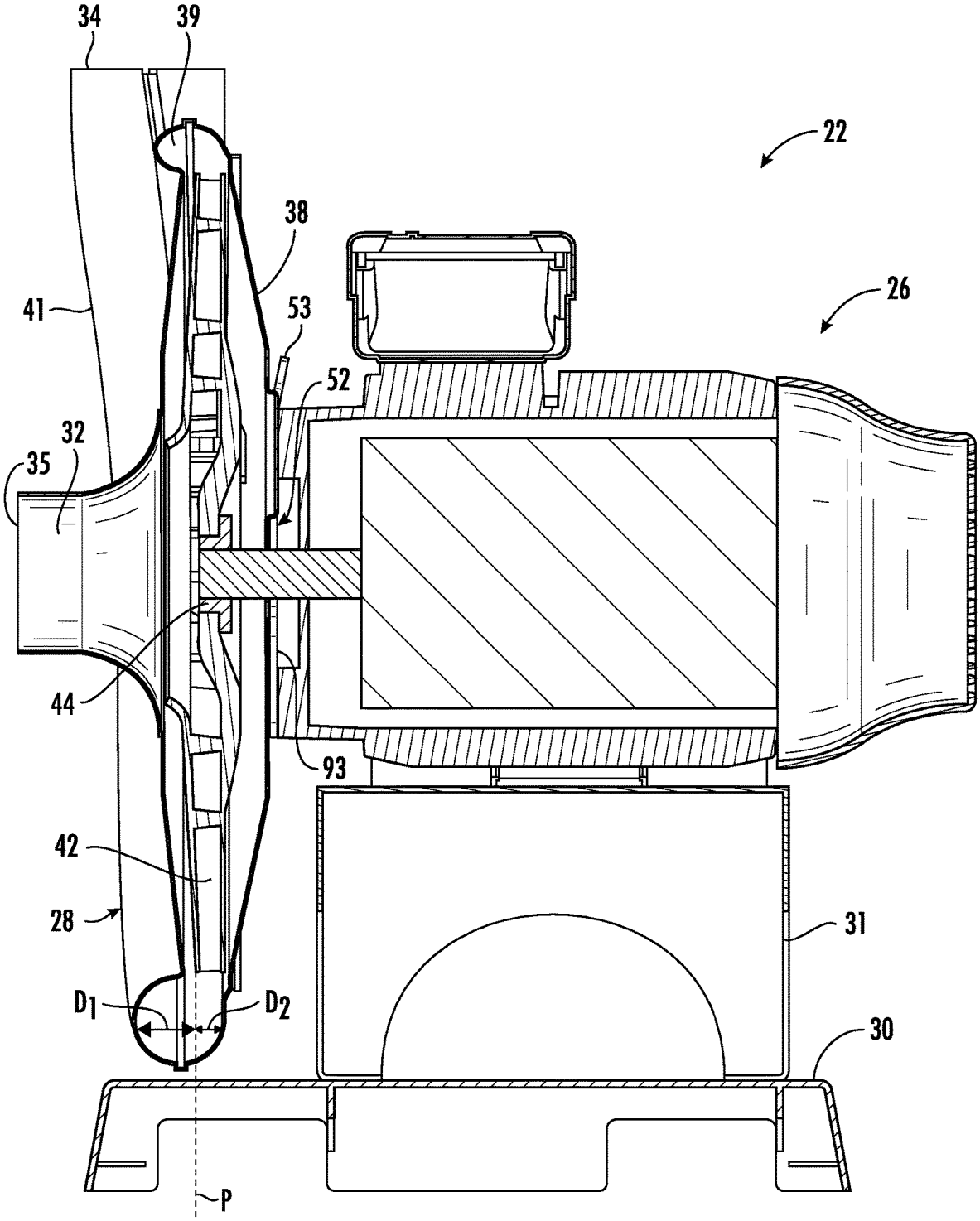
FIG. 6 is a cross sectional view of the vacuum motor assembly according to an aspect of the present disclosure taken along line VI-VI in FIG. 2.

As shown at least in FIGS. 4-6, the impeller 42 is positioned between the front cover 36 and the back cover 38. The channel 39 has an increasing cross-sectional area as the air passes through the channel 39 toward the outlet. Moreover, as best shown in FIG. 6, the distance (D1) within the channel 39 from the plane "P" defined by the front surface of the impeller to the interior facing surface of the front cover 36 is greater than the distance (D2) at the same point within the channel 39 from the same plane to the interior facing surface of the back cover. D1 is typically greater than D2. The impeller is typically not positioned in the center of the air channel front to back, but rather is positioned closer to the motor and the back portion 38. The position of the impeller and the configuration and structural shape of the outer channel portion 39 restricts and greatly reduces random air currents. The spatial relationship of the impeller 42 within the cover 28 is such that a greater volume of air within the channel is present in front of the impeller 42, which facilitates the reduction in random air currents. The air currents or eddies in the case of the systems of the present disclosure are primarily driven along the perimeter of the channel 39 due to this positioning, most typically in the direction of the front portion 36 of the vacuum pump assembly 24. The air currents are guided along the channel 39 in the direction of the primary flow of air and typically form a stable airflow without irregular air movement. The lessening of the random air currents reduces additional heat build-up due to fewer air molecules colliding with one another during use of the overall system. This also lowers vibrations and vibrational damage that may occur if more random airflow patterns are created by the impeller 42. This configuration of the vacuum pump assembly 24 with the impeller positioned further reward toward the motor within the cover 28 typically creates a quieter system as well. The stable airflow created by the cover 28 of the present disclosure reduces the instability of the overall vacuum motor assembly 22 and reduces the amount of heat building up in the vacuum pump assembly 24 thereby extending the useful life of the systems of the present disclosure before maintenance or replacement is necessary.

The front portion 36 of the cover 28 typically has a forwardly extended enlarged channel section 37 around its perimeter. The channel section 37 contains an airflow channel 39 in its interior that wraps around the impeller 42 and ultimately leads/directs airflow to the outlet 34. The channel 39 is a space within the cover 28 that is defined by the channel section 37 and a channel forming section 33 of the back portion 38, which can conceivably be the entire back portion 38. Typically, the airflow channel 39 center is not aligned with the same vertical plane that the impeller 42 lies in, and the impeller is spaced slightly rearward as discussed above to direct airflow into the channel 39. As shown in at least FIGS. 6 and 8, where the channel 39 is defined by the back portion 38, its perimeter only slightly curves, but the channel 39 bulges outward away from the motor 26 in the area defined by the channel section 37.

Figure 7:
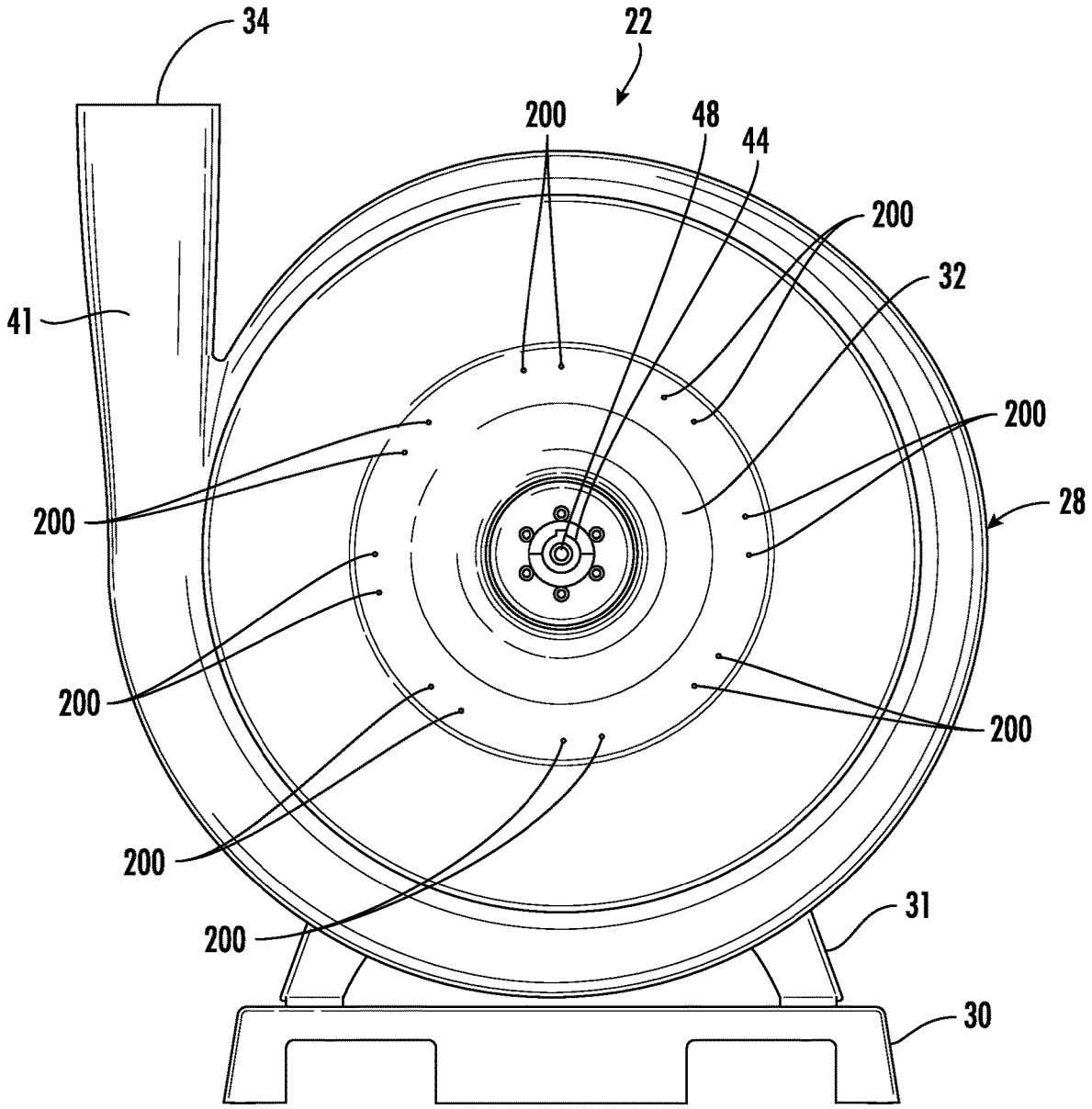
FIG. 7 is a front view of the vacuum motor assembly with the bell shaped inlet removed according to an aspect of the present disclosure.
Figure 8:
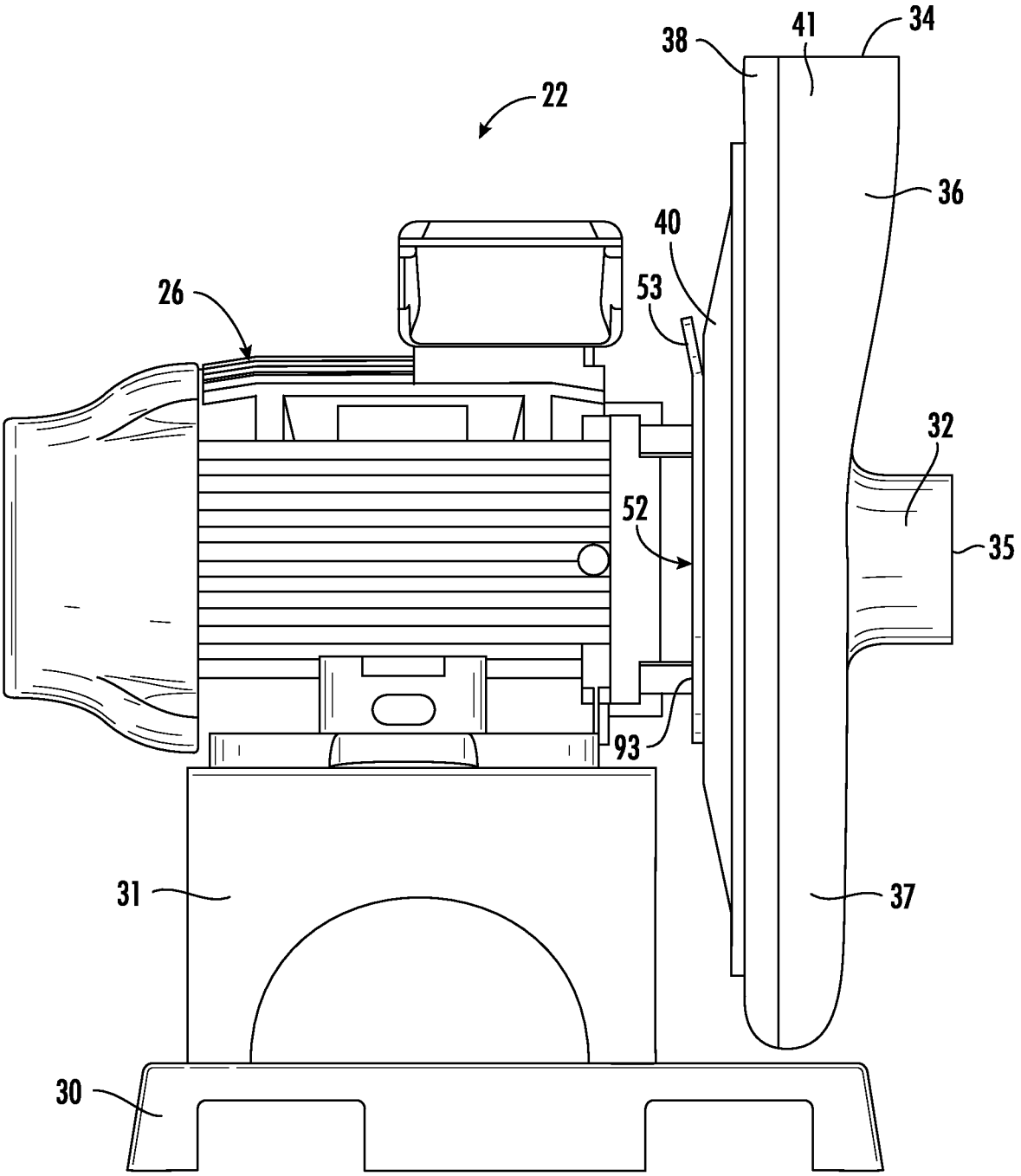
FIG. 8 is a left side view of the vacuum motor assembly according to an aspect of the present disclosure.
Figure 9:
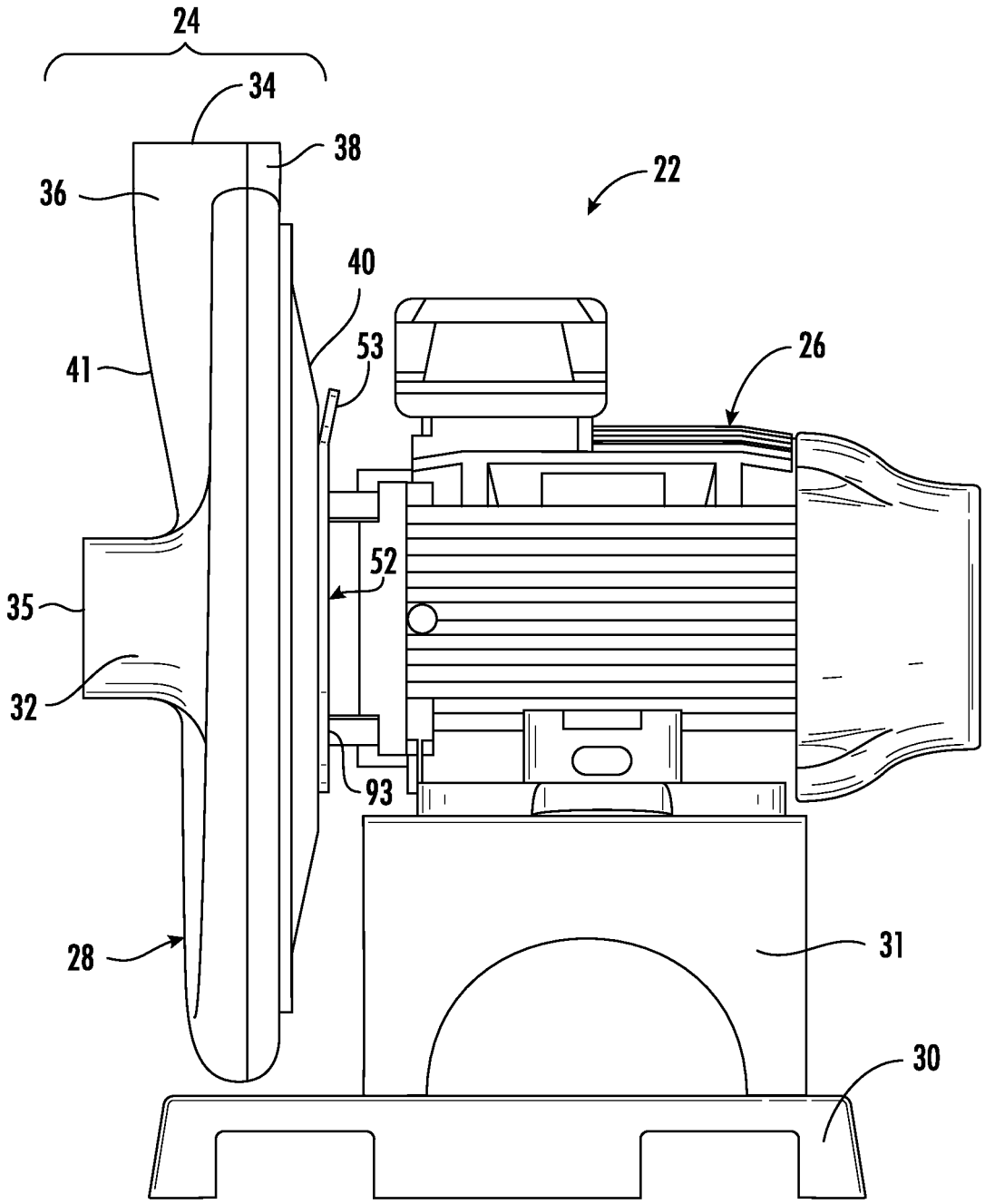
FIG. 9 is a right side view of the vacuum motor assembly according to an aspect of the present disclosure.
Figure 10:
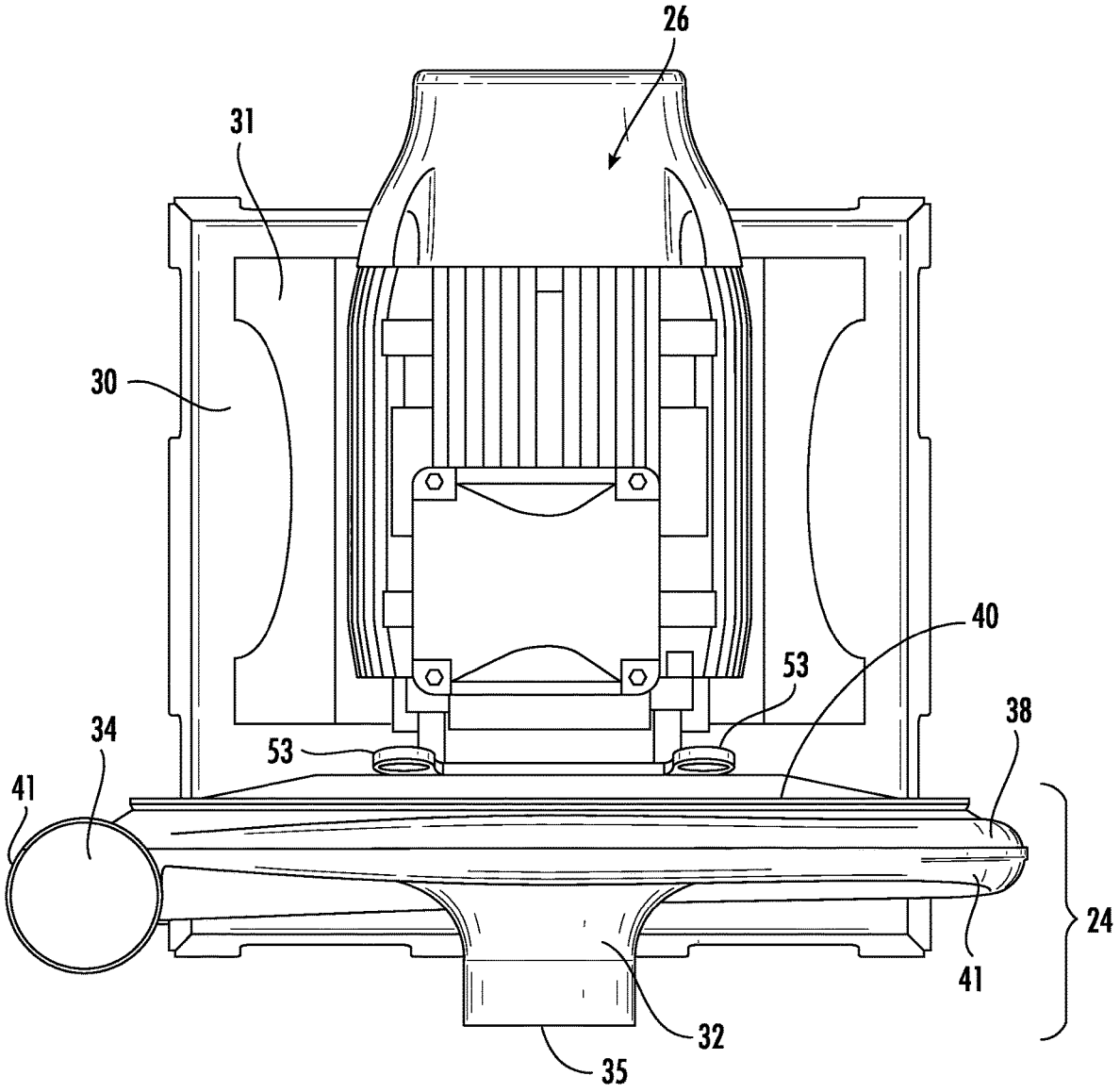
FIG. 10 is a top view of the vacuum motor assembly according to an aspect of the present disclosure.
Figure 11:
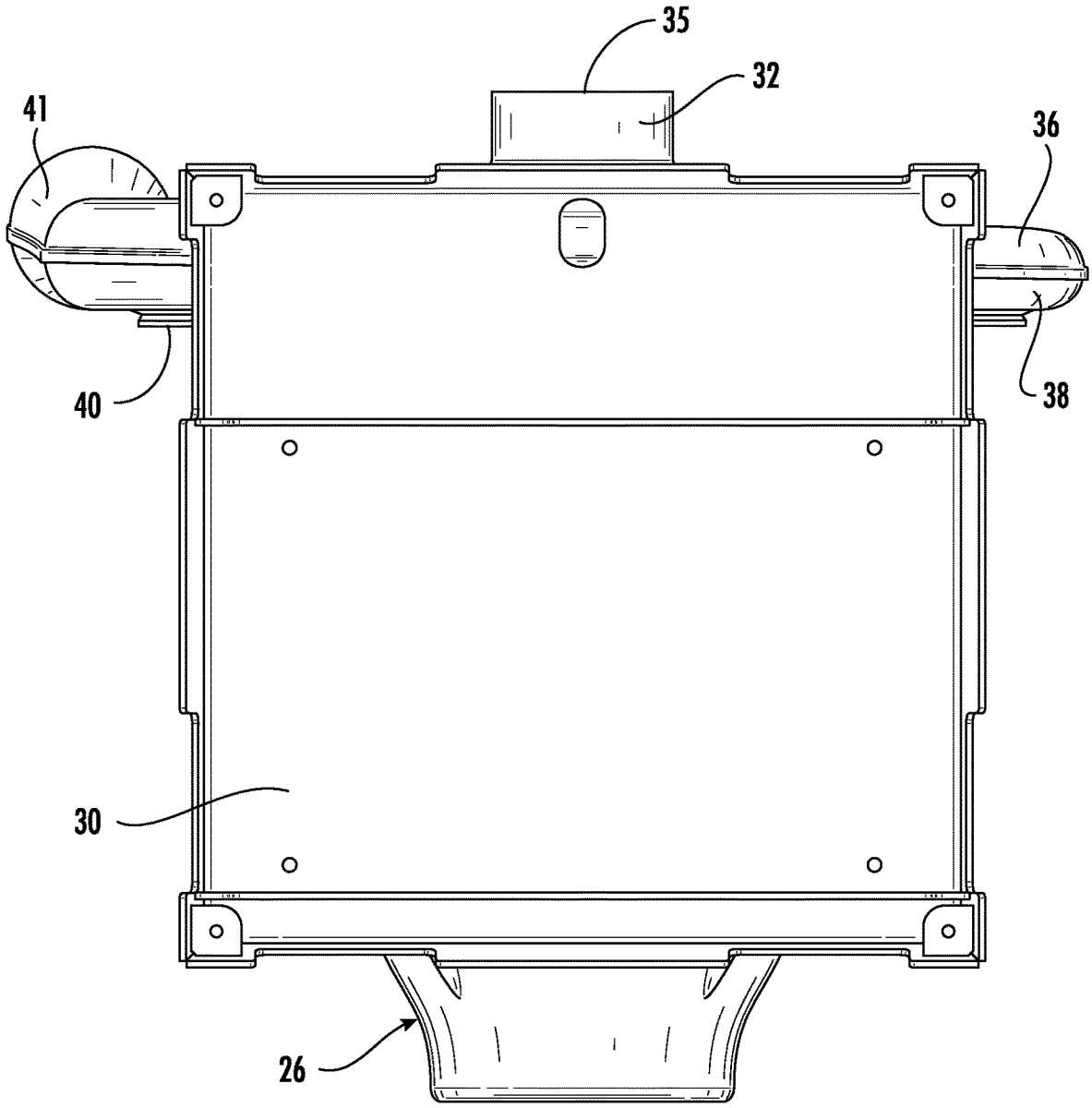
FIG. 11 is a bottom view of the vacuum motor assembly according to an aspect of the present disclosure.
Figure 12A:
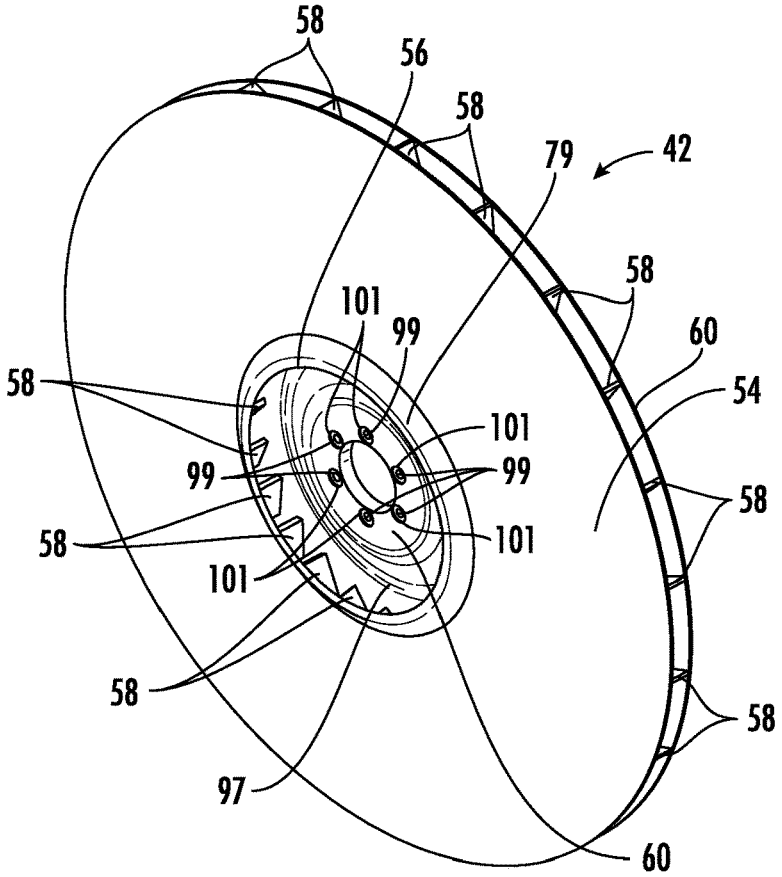
FIG. 12A is a front perspective view of the impeller according to an aspect of the present disclosure.
Figure 12B:
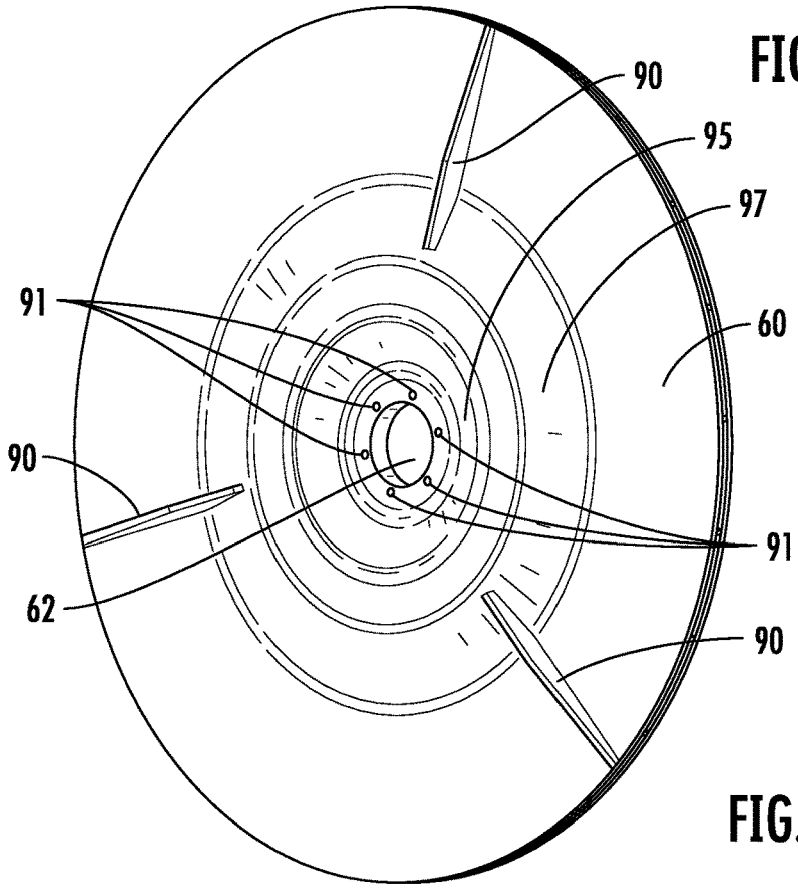
FIG. 12B is a rea perspective view of the impeller according to an aspect of the present disclosure.

A bell-shaped center intake pipe 32 that defines an inlet 35 is attached to the front portion 36 and engages threaded fastener receiving apertures in the exterior facing surface of the front portion (See FIG. 7). An impeller 42 is suspended between the front portion 36 and the back portion 38 and attached to the drive shaft 48. A thermostatic valve 50 may be disposed in the back support 40 to help facilitate cooling along with a pair of spacers 52 are attached between the back support 40 and the motor 26 that further facilitate cooling as discussed in more detail herein. A main vacuum line 20 connects with the bell-shaped center intake pipe 32 in order for air in the system to enter the vacuum motor 26. The vacuum motor assembly 22 may be positioned on top of a base 30 portion so the cover 28 does not contact the ground and possibly sustain damage due to vibration.

The cover 28 typically completely encases/surrounds the impeller 42 and generally forms a spiraling shape that is a volute-like structure, with the front portion 36 of the cover 28 being asymmetrical with the back portion 38, but matingly engageable with one another. The front portion 36 forms a majority of the spiraling shape when mated with the back portion. The front portion and the back portion are typically not symmetrical halves since having symmetrical halves typically causes turbulent airflows going conflicting directions whereas the design of the present construction where a majority of the internal volume of the airflow channel 39 is formed by the front portion 36, the greater volume of air/fluid flow volume in front of the impeller greatly lessens or eliminates the competing airflow directions and thereby lowers turbulence within the system and reduces wear and noise. The front portion 36 of the cover 28 is typically engaged with the back portion 38 of the cover 28. The front portion 36 may be engaged with the back portion 38 using a snap fit configuration, a plurality of fasteners positioned around the perimeter of the cover 28 or using an O-ring or other gasket/airflow restricting material, typically within a groove, around the perimeter that provides greater protection against airflow loss outside of the channel 39 when in use. In such configurations a lip around the back portion 38 or the front portion 36 may be employed circumferentially around the perimeter. An outlet 34 for the release of air pushed through the vacuum pump assembly 24 is formed by the front portion 36 of the cover 28 and a back portion 38 of the cover 28 when they are engaged with one another. The front portion 36 typically has a central aperture 47 defined by an internal perimeter rim 49. The exterior facing side of the front portion 36 engages the bell-shaped center intake pipe 32 and is held in place using one or more spaced apart fasteners, typically bolts. The bolts are typically placed into engagement in a spaced apart arrangement along the perimeter portion 55 of the outwardly extending flange of the bell-shaped center intake pipe 32 and engage with corresponding apertures 200 (See FIG. 7).

The back portion 38 is typically generally circular and concave when viewed from the front but with a portion of the air exhaust chute 41 included. The back portion 38 may have a large circular centrally positioned gap/aperture at its center that is defined by the interior perimeter edge 57 of the back portion 38. The aperture is typically large and typically encompasses the majority of the diameter of the back portion 38 as best shown in FIGS. 4 and 5. The back portion 38 forms a generally ring-like structure that widens on the side corresponding to the outlet 34 and forming part of the outlet 34.

As shown in FIGS. 4, 5 and 15-18, a back support 40 is typically attached to the cover 28 such that it completely covers the gap in the back portion 38. The back support 40 typically has a concave, impeller-facing side and a convex, motor-facing side. It is possible that the back support may be planar as well. The back support 40 is typically bolted to the back portion 38 of the cover 28 or otherwise securely engaged with it by any other means in the art. The back portion typically has a plurality of apertures 59 equally spaced apart and around the perimeter 61 of the back cover. These spaced apart apertures 59 typically matingly engage the threaded bolts 65 or other fastening mechanisms of the back portion 38. The back support 40 also typically has a drive shaft receiving aperture 220, which is typically located at its center.

The back cover 38 also may include a plurality of holes 51 spaced in a square configuration and located to receive a fastener that engages spacers 52 and the motor 26 at threaded attachment locations 27 in the motor 26. Since there are more attachment locations circumferentially located about the drive shaft of the motor, the back support 40 and thereby the entire vacuum pump assembly may be oriented in different positions depending on how the vacuum pump assembly/the back support 40 are mounted. The holes 51 allow for bolts, rivets, or other attachment means to connect the back cover 38 to the motor 26.

Figure 21:
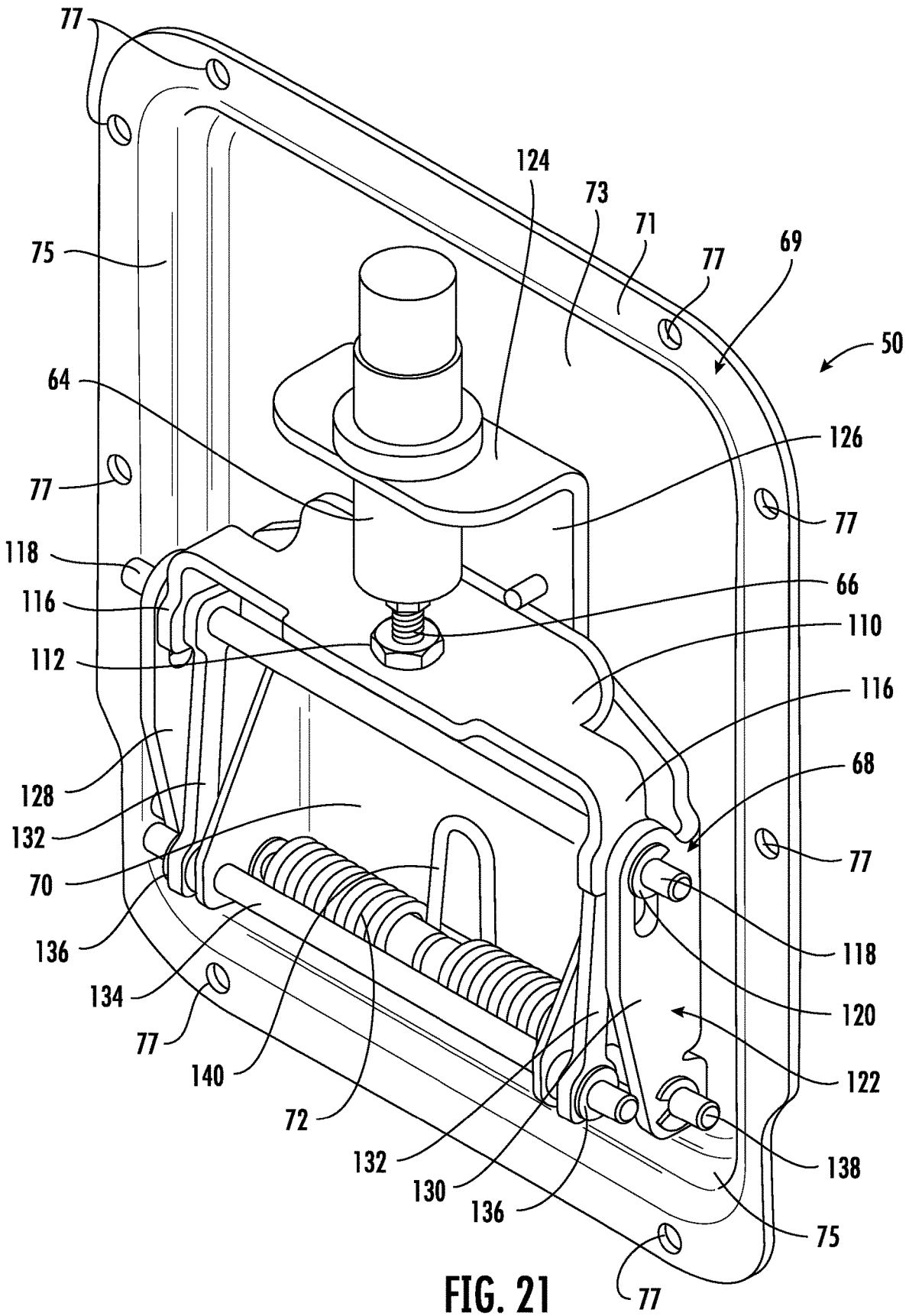
FIG. 21 is a rear perspective view of a thermostatic valve assembly with the thermostatic valve in the closed position according to an aspect of the present disclosure.

The back support 40 also typically has a thermostatic valve receiving aperture 67 that receives the thermostatic valve 50. The thermostatic valve 50, as shown in FIG. 21, typically has a mounting framework 69 that has a recessed back wall 73, at least one upwardly extending side wall (if the shape is circular or oval), but typically four upwardly extending side walls 75 because the shape is typically rectangular or square. The mounting framework 69 is typically engaged with the back support 40 such that the perimeter lip or rim 71 around the perimeter of the mounting framework such that the rim 71 engages the interior/forward facing surface of the back support 40 that faces the front support and is affixed thereto using a plurality of fasteners that engage the two components with one another through the plurality of spaced apart apertures 77 around the rim 71 such that the thermostatic valve is positioned facing the impeller. The apertures extend completely through the rim 71 to allow a fastener to pass through and engage the back support 40. The fasteners are typically bolts and nuts or other threaded fastener(s).

Advantageously, the cover 28 can also be easily field/on-site serviced and facilitate easier field/on-site servicing of the vacuum motor assembly 22. One feature that assists in the field servicing of the assembly of the present disclosure is the fact that the cover 28 can be completely removed from the back support 40 of the vacuum motor assembly 22. When separated from the back support 40, the large opening in the back portion 38 (See FIGS. 15 and 18) of the cover 28 (includes both the front portion 36 and the back portion 38) allows for the removal of the cover 28 without the cover 28 catching on the impeller 42. In this way, a user or repair person can easily access the impeller 42 and thermostatic valve 50, as well as other components if they are worn or broken and in need to replacement. To do so, one would simply disengage the fasteners holding the back portion into engagement with the back support. This is a significant improvement over prior designs where the entire system including the motor 26 would need to be brought into or shipped to a shop for service that is remotely located from the vehicle washing facility causing significant downtime or added expense to have an "extra" system onsite or supplied to replace the system being repaired. This is obviously undesirable considering the size of the vacuum motor assembly 22 and the potential cost to ship it in its entirety to a remote location and the potential downtime and expense. The present vacuum motor assembly 22 eliminates possible shipping concerns and overall expenses on the user while also providing an easier to replace impeller 42 system.

Another useful aspect of the vacuum motor assembly 22 of the present disclosure is the ability to use the vacuum pump assembly 24 with any standard motor 26. As long as the particular motors have a compatible mounting and drive shafts of the proper length, they are useable and interchangeable without effecting the performance of the vacuum motor 26. The increased efficiency of the vacuum motor 26 is due to the cover 28 and the impeller 42, so the exact features and specifications of the motor 26 do not matter. This also makes the vacuum motor 26 more field serviceable, as discussed above, because a user can just swap either only the cover 28 (or a portion thereof), the impeller, the valve, or the motor 26 when any one or more are damaged, the performance is compromised or otherwise unusable.

Seen in at least FIGS. 4, 5, 12, and 13 impeller 42 may be a closed impeller that, as discussed in more detail herein is also recessed. The impeller 42 typically includes a front shroud 54 with an impeller eye 56 in its center, a back shroud 60 that typically has a plurality of support laterally extending struts 90 on the outward facing side of the back shroud, a hub connection portion 62 in its center that defines a drive shaft engaging aperture at its center, and a series of impeller vanes 58 that connect to the interior facing surface of the front shroud and the interior facing surface of the back shroud 60. These components typically form a single unit. The overall impeller 42 is typically a metal (most typically aluminum) diecast component. The impeller eye 56 is the central portion of the impeller 42, defined by a circular opening in the front shroud 54 of the impeller 42. The circular opening on the front surface (side facing away from the motor) may have an outwardly extending lip 79 around the perimeter thereof, but it may also be planar. The rearward facing surface as shown in at least FIG. 5 typically has a recessed center section 95 with a raised ring section when the impeller is viewed from behind. The recessed center section 95 corresponds to a raised center section 97 on the opposing side of the back shroud 60. The recessed center section 95 typically has a plurality (most typically six) evenly spaced apart fastener receiving (typically bolt receiving) apertures 99. On the impeller vane facing side of the back shroud, these apertures have a countersunk cylindrical rim section 101 that receives the bolt head when a bolt is used as the fastener so that the bolt head does not extend into the airflow pathway in a meaningful way.

Figure 13:
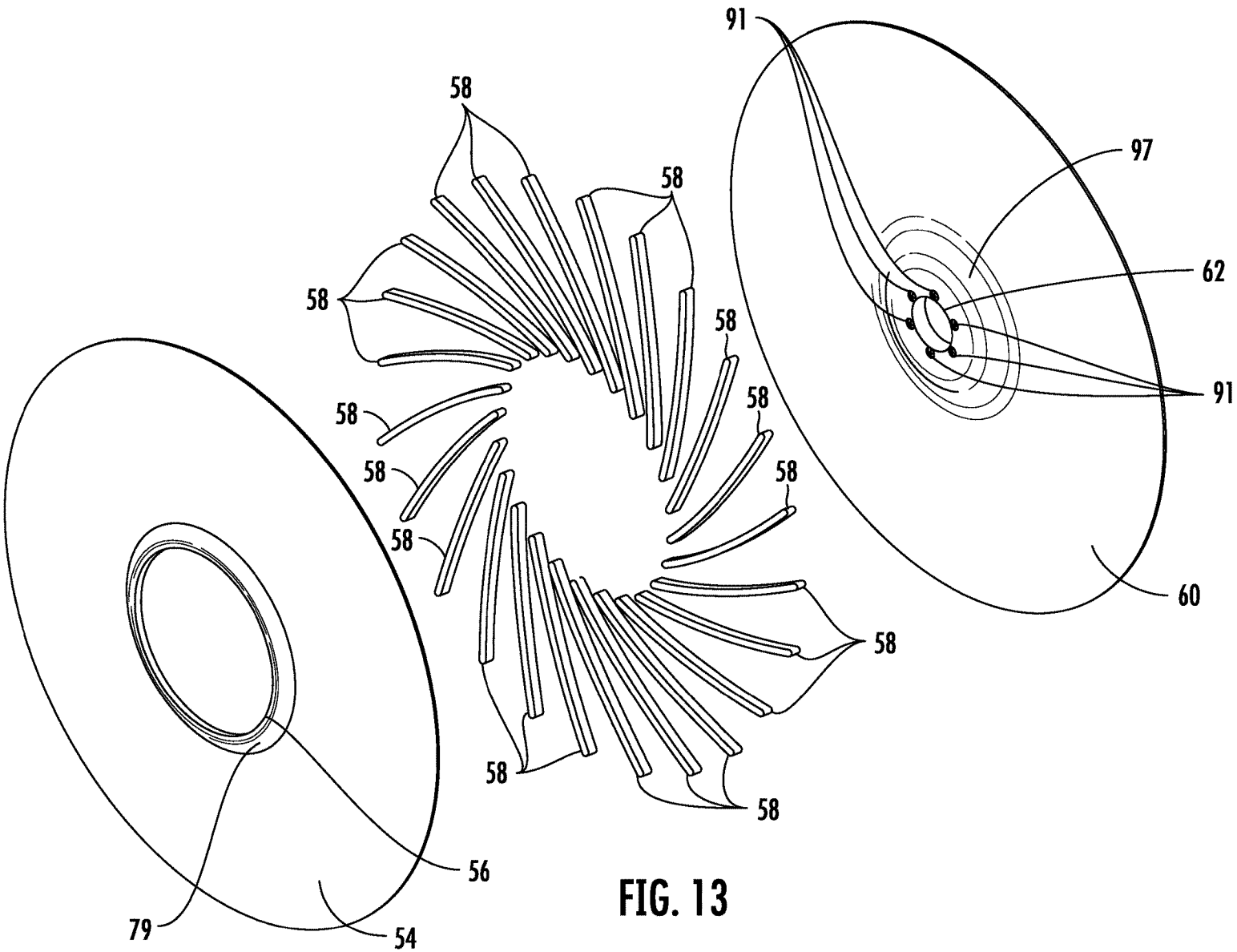
FIG. 13 shows an exploded view of the impeller and the impeller vanes according to an aspect of the present disclosure.
Figure 15:
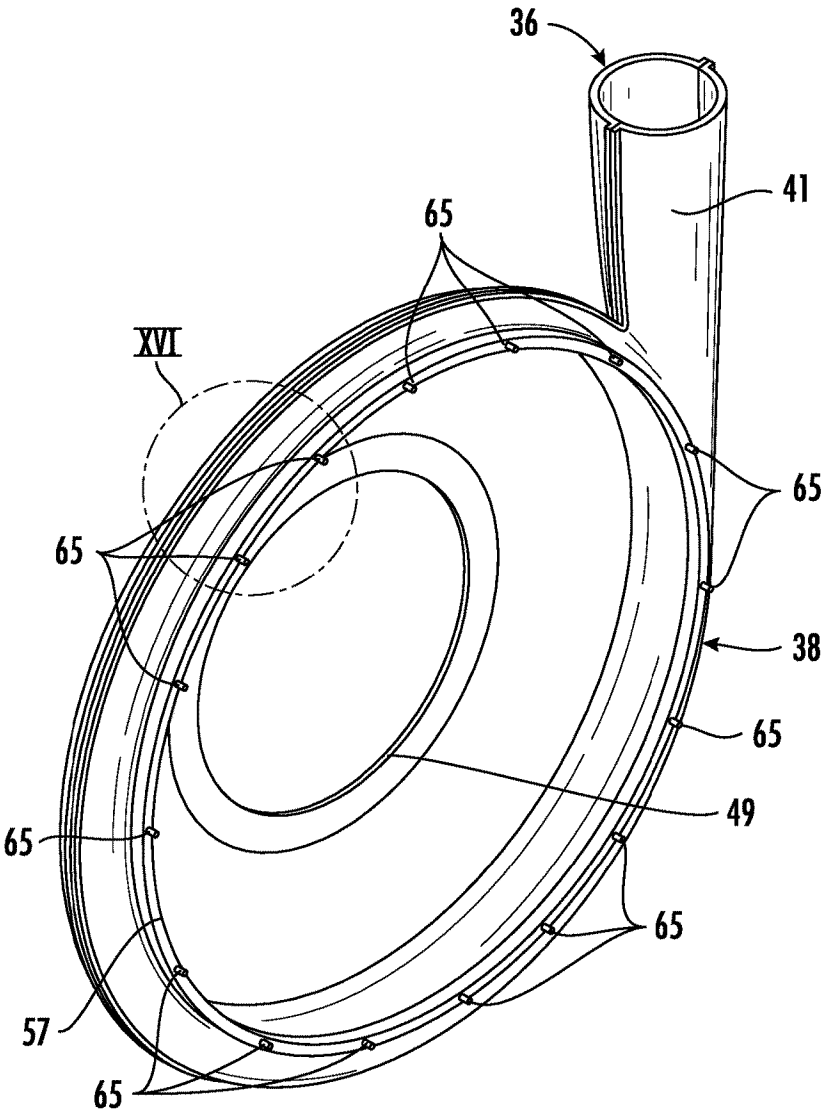
FIG. 15 is a rear perspective view of the cover of the impeller with the impeller missing and the back support not engaged with the cover according to an aspect of the present disclosure.
Figure 14:
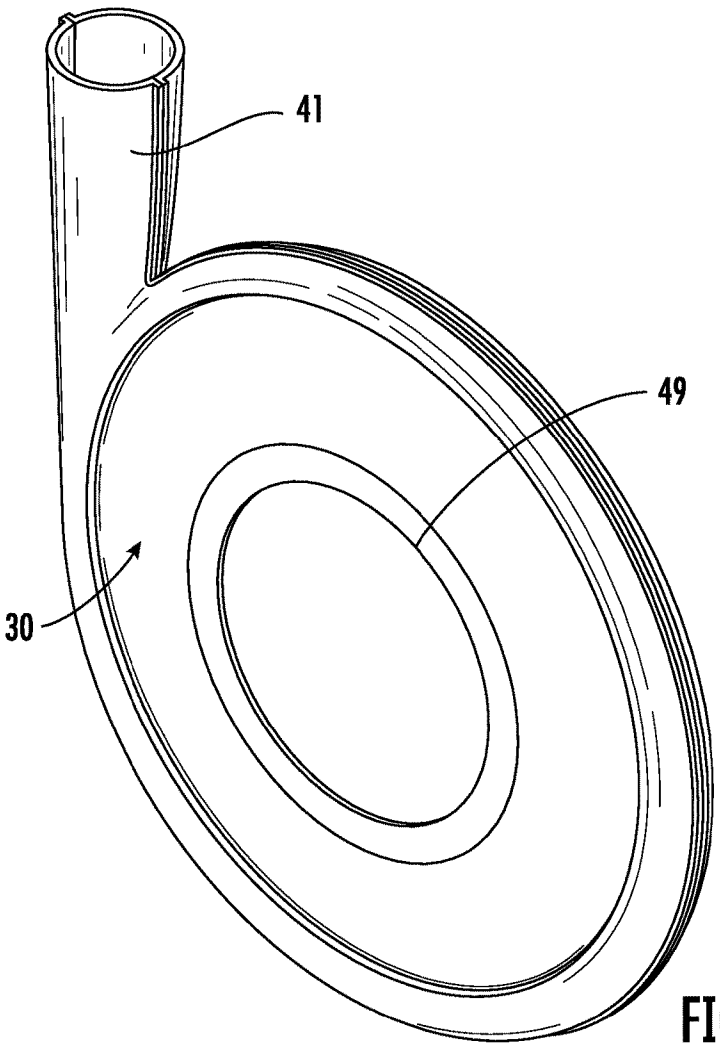
FIG. 14 is a front perspective view of a cover of impeller according to an aspect of the present disclosure.
Figure 16:
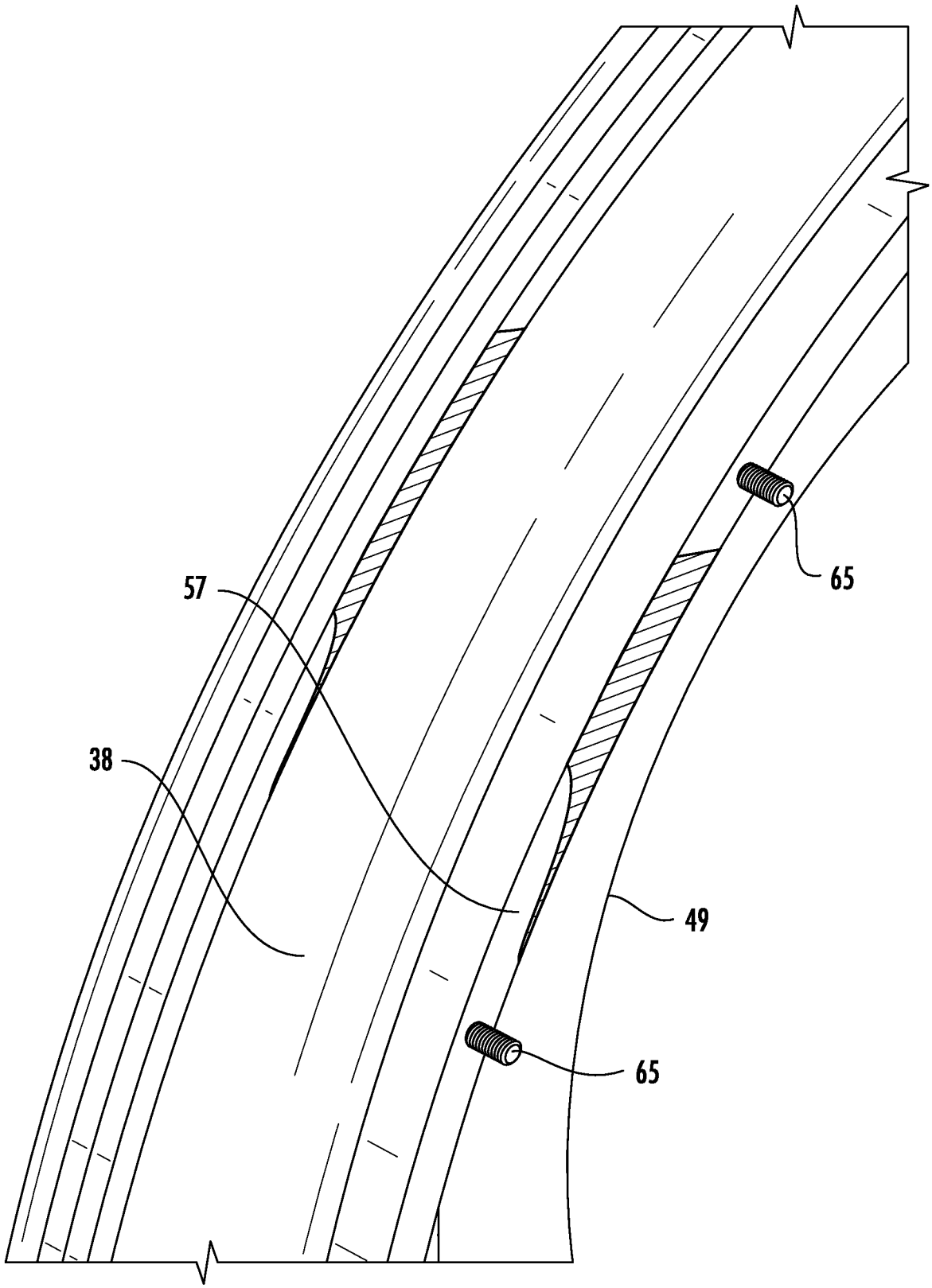
FIG. 16 is an enlarged view of area XVI in FIG. 15 according to an aspect of the present disclosure.
Figure 17:
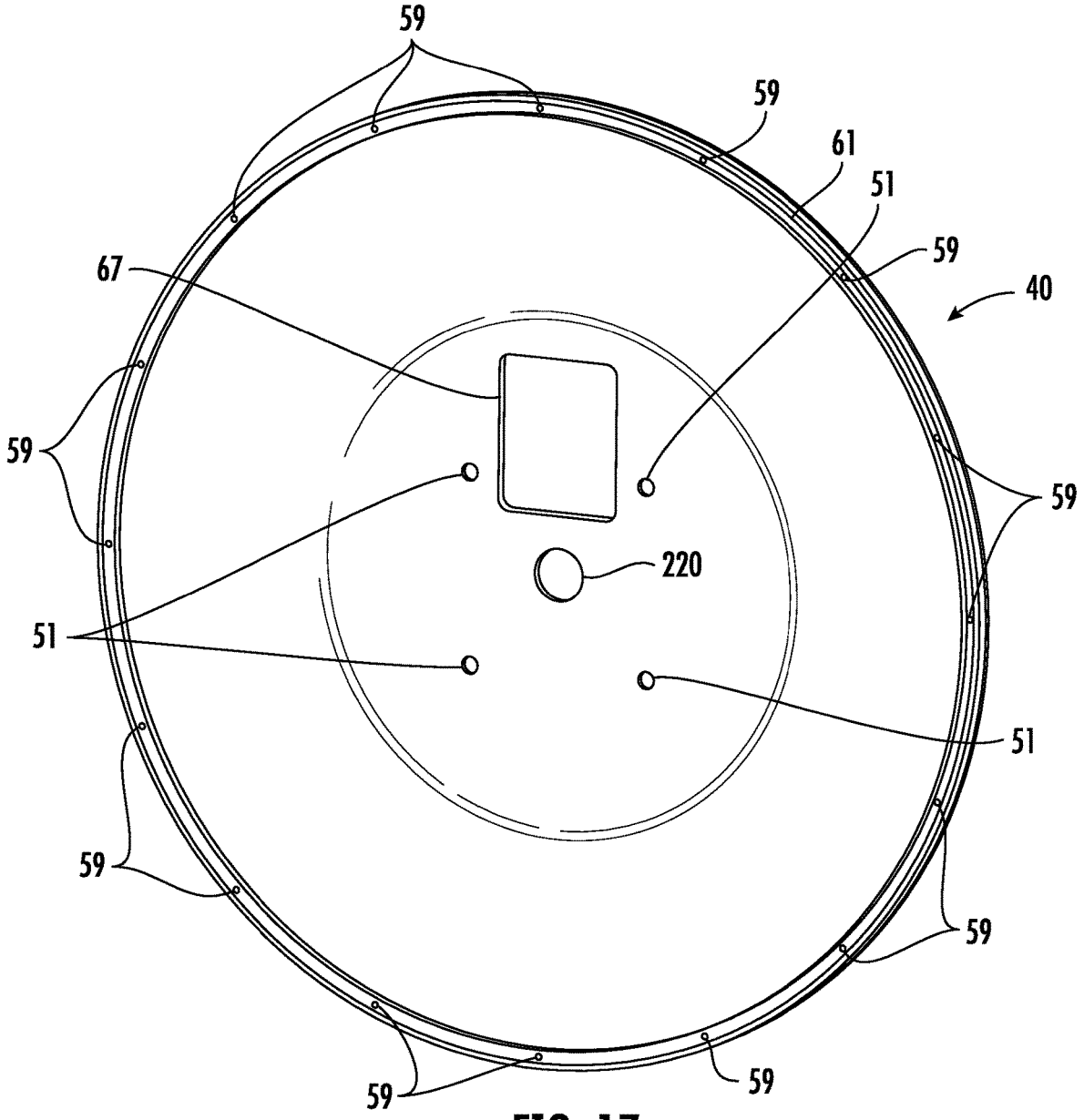
FIG. 17 is a front perspective view of a back support according to an aspect of the present disclosure.
Figure 18:
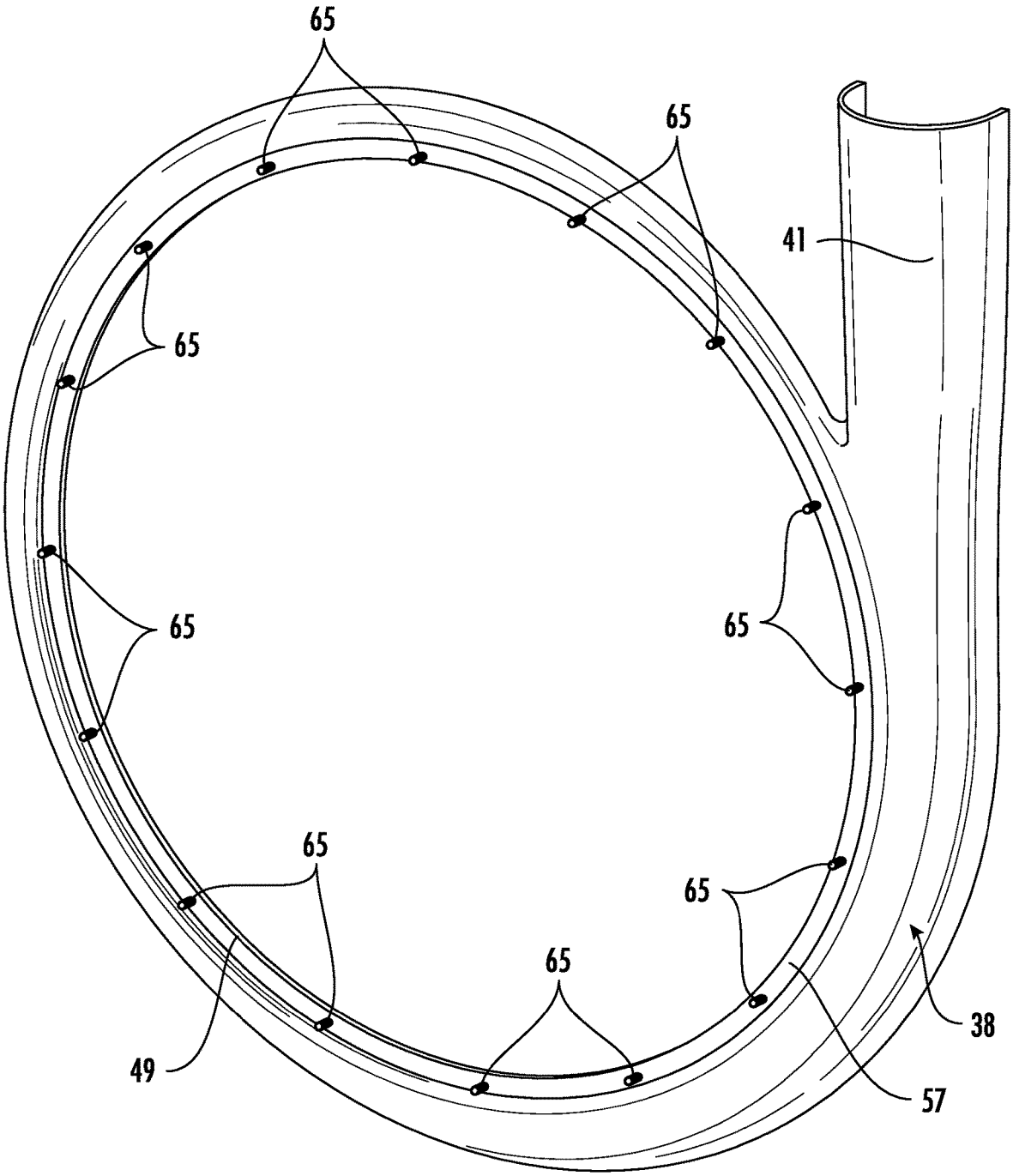
FIG. 18 is a rear perspective view of a back portion of a cover according to an aspect of the present disclosure.

The impeller vanes 58 originate along the perimeter of the impeller eye 56, and extend radially outwards to the perimeter of the shrouds. The impeller 42 will typically employ 24 impeller vanes, but may include more or less vanes as well. Typically, the impeller will include from 18 to 30 vanes. As shown in FIG. 13, each vane is typically slightly arched so as to push air in the same direction within the impeller, and each vane typically has the same length and the same curvature. When viewed from the front without a front shroud, the impeller vanes 58 are placed in a generally spiral formation. The spaces between the vanes increase in width the further from the impeller eye 56 they are. Additionally, each impeller vane 58 is typically identical to one another in size and shape.

The impeller 42 is operably engaged to the motor 26 via a driveshaft 48, and is not directly connected to the cover 28. The drive shaft 48 is attached to the hub connection portion 62 in the center of the back shroud 60 via a hub 44 (shown in FIG. 19). As shown in at least FIGS. 7 and 19, the hub 44 is attached to the drive shaft 48 of the motor. The drive shaft of the motor is positioned within the center of the hub 44 and affixed thereto using screws (not shown) that engage the motor's drive shaft through threaded apertures 81 typically in the top and bottom of the center ring 83. The center ring extends away from a base ring 85 that is integral with the center ring, but has a beveled perimeter recess 87 between the center ring and the base ring of the hub. The base ring further includes a plurality of threaded apertures 89 typically spaced evenly around the perimeter portion of the base ring not covered or otherwise obstructed by the center ring and the threaded apertures 89 are perpendicular to the top planar surface of the base ring. These threaded apertures 89 engage fasteners, typically bolts, which fasteners also engage corresponding attachment apertures 91 on the back shroud of the impeller 42. The hub further typically includes a clamping bolt mechanism employing, for example, a hex head screw bolt within the threaded apertures 103 that align with one another such that as the threaded hex head bolt is tightened, a clamping force is applied. The threaded apertures 103 are typically on one side of the center ring that further engages the drive shaft of the motor with the hub. The slide slots 105 in the center ring portion facilitate the added clamping force action. The center ring portion also typically includes a cutout portion that corresponds to a portion of the motor drive shaft to provide the rotational force to the impeller through the engagement of the drive shaft with the hub and the hub with the impeller.

When the motor 26 is running, the impeller 42 spins clockwise in the opposite direction that the vanes are curved towards. The curves force the air to move in a set direction within the channel 39. If the outlet 34 is located on the opposite side, the vanes would need to curve to the right and the impeller 42 would need to spin in a counterclockwise direction. As discussed above, the impeller 42 is typically cast as a unitary piece, making it more resistant to debris sucked into the vacuum motor 26 by not having loose and breakable joint sections.

When the vacuum motor assembly 22 is in operation, the motor 26 turns the impeller 42 using the drive shaft 48. Air travels through the hoses 18 into the main vacuum line 20, wherein it will flow to the bell-shaped center intake pipe 32 of the vacuum pump assembly 24. From there it enters the impeller eye 56. The rotating impeller 42 accelerates the air outward along the spinning impeller vanes 58 using centrifugal force. The air leaves the impeller 42 and enters the surrounding channel 39 at a high velocity. As the channel 39 widens its cross-sectional area the air speed decreases and the air pressure increases. This is due to the venturi effect, which is the reduction of pressure through a constricted section of pipe, or the inverse, the increase of pressure though an expanded section of pipe. The flowrate through the channel 39 must be the same throughout, so the air speed drops as the channel 39 expands to compensate for increased volume of air. Slower moving air produces more pressure, the air pressure in the channel 39 increases the closer the air moves to the outlet 34. In this way, the vacuum motor 26 reclaims pressure lost by the fast-moving air in the hoses 18 and gives the air a pressure equal to or greater to the air pressure outside of the vacuum motor 26. The air then is forced out of the system at the outlet 34 due to the high pressure of the volume of air. If the vacuum pump assembly 24 of the vacuum motor assembly 22 or similar system does not reclaim the pressure lost in the main line, the air will not be able to leave through the outlet 34.

Figure 20:
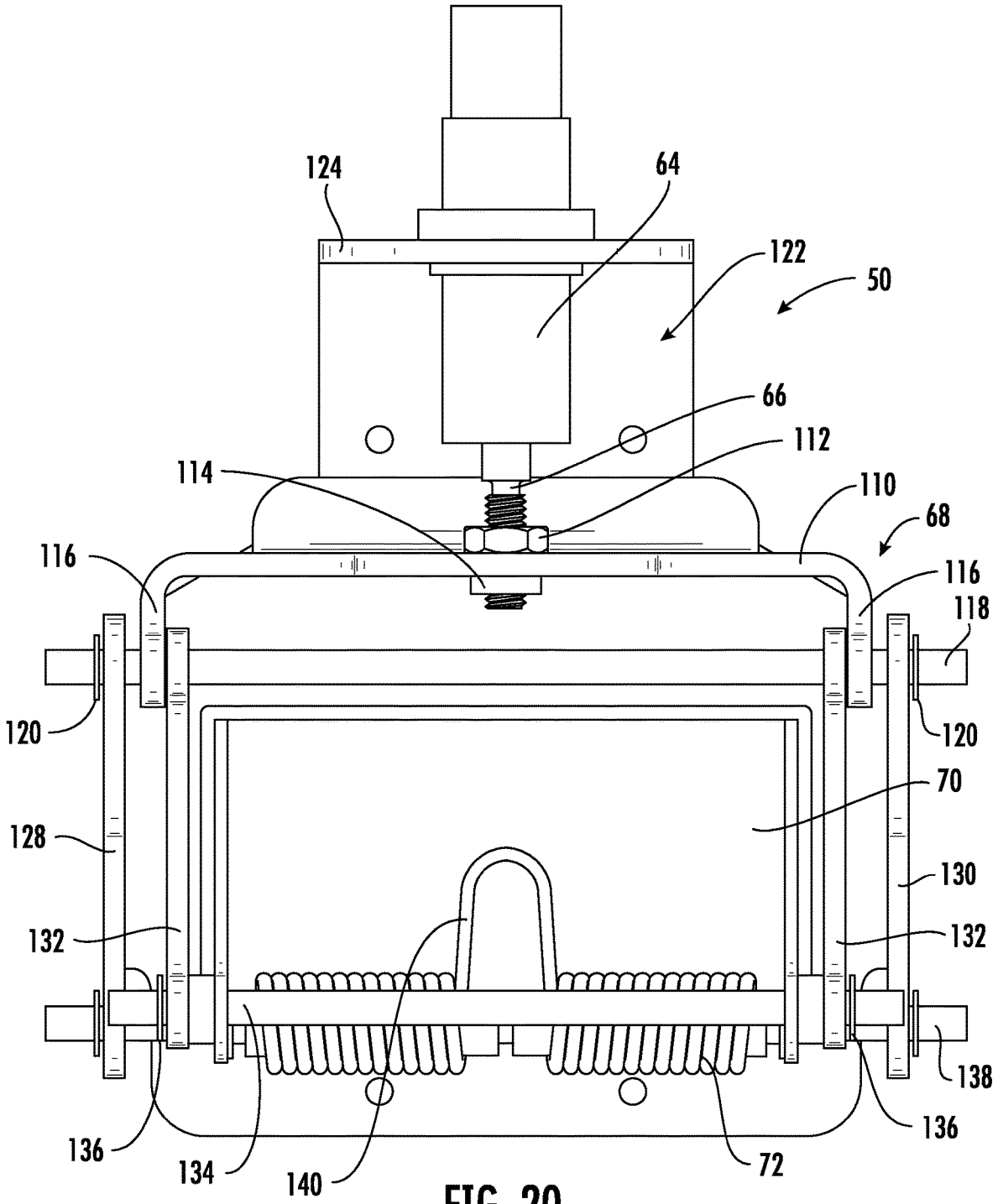
FIG. 20 is rear view of a thermostatic valve assembly with thermostatic valve in the closed position according to an aspect of the present disclosure.
Figure 22:
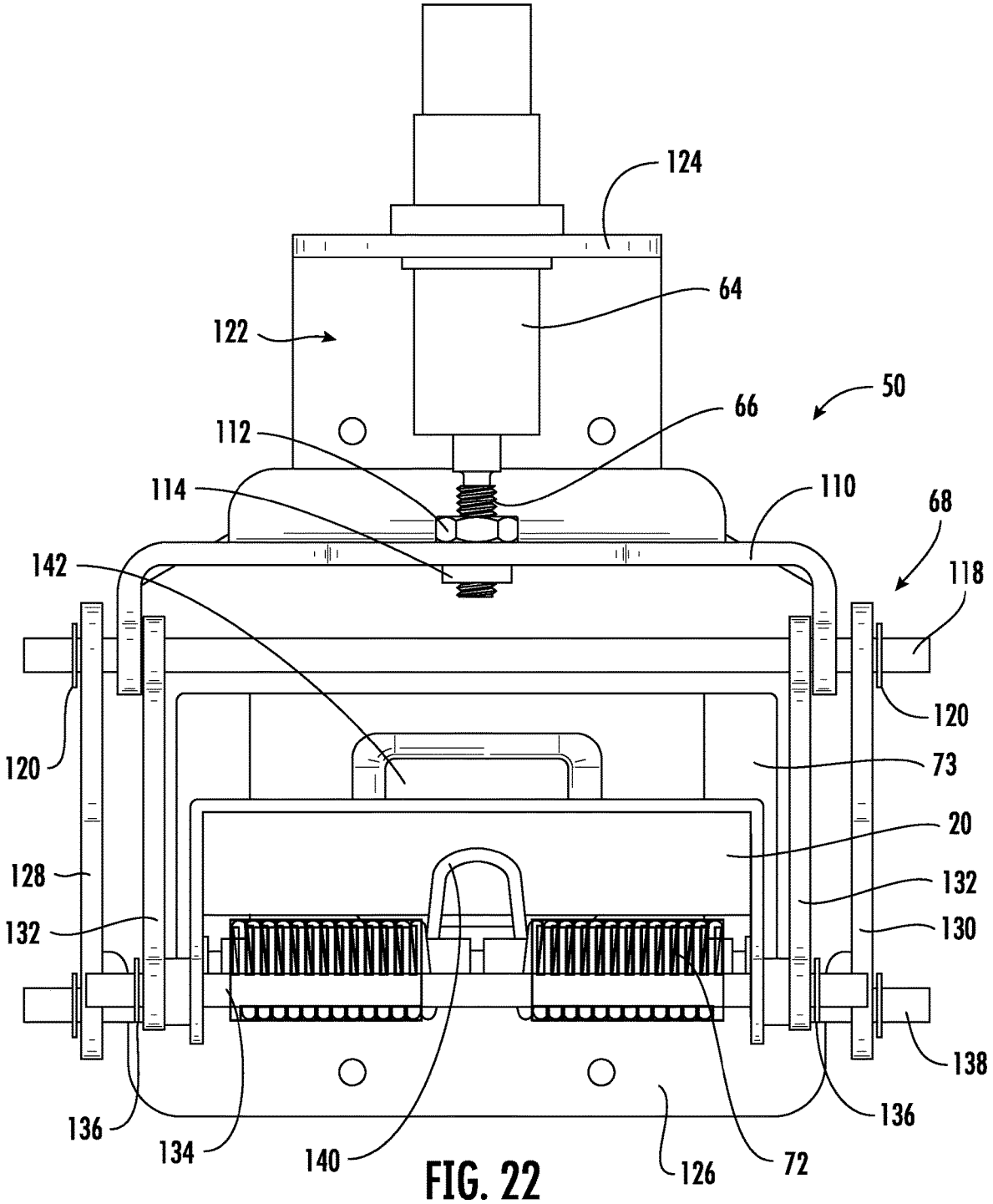
FIG. 22 is a rear view of a thermostatic valve assembly with the thermostatic valve in the open position according to an aspect of the present disclosure.

Referring to FIGS. 20-22, a thermostatic valve 50 may be engaged with the cover 28 to reduce the temperature of the vacuum pump assembly 24. The impeller 42 and the motor 26 can build up large amounts of heat due to air pressure and friction from the constant use of the motor 26. Without a cooling mechanism, the impeller 42, drive shaft 48, and vacuum pump assembly 24 components may become soft and susceptible to damage or other unintended changes. They may also melt if the temperature is high enough. So, to keep the components from becoming damaged, a thermostatic valve 50 is typically employed in the systems of the present disclosure that releases the heated air. The thermostatic valve 50 of the present disclosure typically includes an actuator 68, a valve door 70, and a wax motor 64. The wax motor 64 contains a volume of wax and a piston 66. The piston engages the bridge 110 and held in position using a nut 112 on the upper surface and a nut 114 on the lower surface to clamp the threaded piston 66 into engagement with the bridge 110. The bridge 110 has two downwardly extending sides 116 that each have an aperture therein that receives a first axle 118. The first axle has circumferential grooves that receive C-shaped washers 120 that retain the first axle 118 into engagement with the bridge and the thermostatic valve support frame 122. The thermostatic valve support frame typically includes a wax motor mounting flange 124, a main support frame portion 126 that extends downward from the wax motor mounting flange and around the opening in the recessed back wall 73, a first side support flange 128, and a second side support flange 130. A support bar 132 interconnects the first axle 118 and a second axle 134 on each side of the thermostatic valve support frame 122 and are held in place using C-clamping washers 136. The system further includes a spring 72 about a third axle 138. The spring has a door biasing arch-shaped upwardly extending portion 140 that is engaged with the interior surface of the door and biases the door into a closed position against the recessed back wall to cover an opening in the recessed back wall 73.

Upon heating of the wax due to heating of the air proximate the thermostatic valve 50 during use of the systems of the present disclosure, the wax within the wax motor 64 forces the piston 66 downward and thereby applies a downward force to the bridge 110 and via the support bars 132, a downward force to the second axle, which then moves downward in an arch-shaped pathway pulling the top portion of the valve door 70 away from engagement with the recessed back 73 thereby opening the air pathway 142 behind the door. As shown in FIG. 22, the opening of the air pathway 142 allows heated air proximate the thermostatic valve to leave to leave from within the vacuum motor assembly to ambient air around the vacuum motor assembly thereby cooling the air within the vacuum motor assembly. There are typically beveled edges around the air pathway, but this is not necessary.

The thermostatic valve 50 is a passive cooling system, without the need for a user or another internal mechanism to activate it. As such, there is no need for a thermometer or another temperature sensing device. After the vacuum pump assembly 24 cools down, the wax volume will also naturally cool down and contract. The piston 66 will no longer have pressure applied on it but it will not return to its original position on its own via a spring within the wax motor 64. The spring 72, now having no/less forces acting on it, is strong enough to keep it compressed against the recessed back wall 73, will return to its original, closed position. The valve door 70 is pushed shut by the spring 72 and the actuator 68 is also pushed upward against the piston 66, forcing it back into its original position. The thermostatic valve 50 is completely reset and it can be opened again any number of times as the vacuum pump assembly 24 heats up and cools down/cycles through uses.

Figure 23:
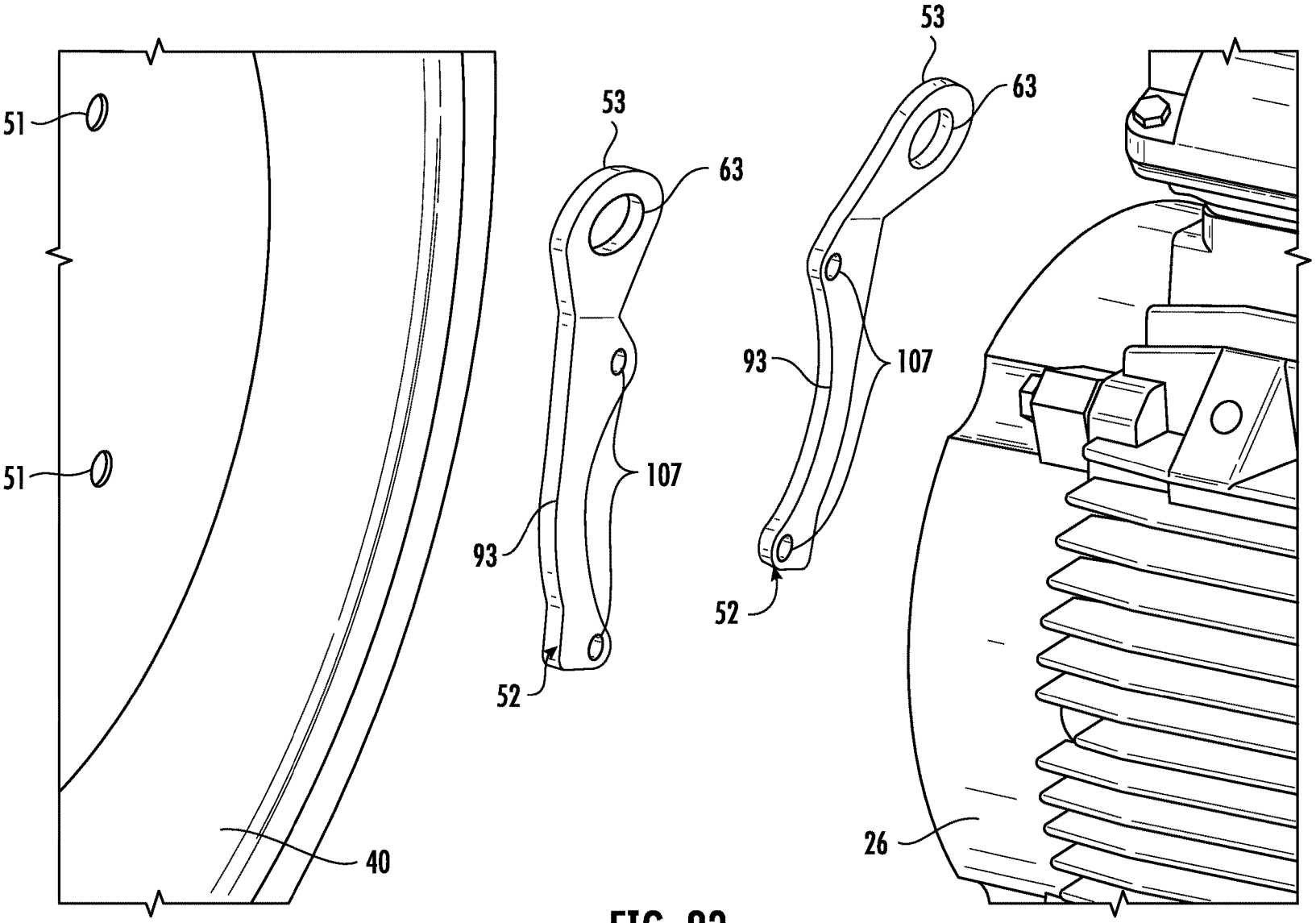
FIG. 23 is rear perspective view of the an enlarged, exploded view of the area XXIII in FIG. 5 showing the motor spacers between the motor and the cover with the thermostatic valve 50 omitted from the enlarged exploded view of this figure according to an aspect of the present disclosure.
Figure 24:
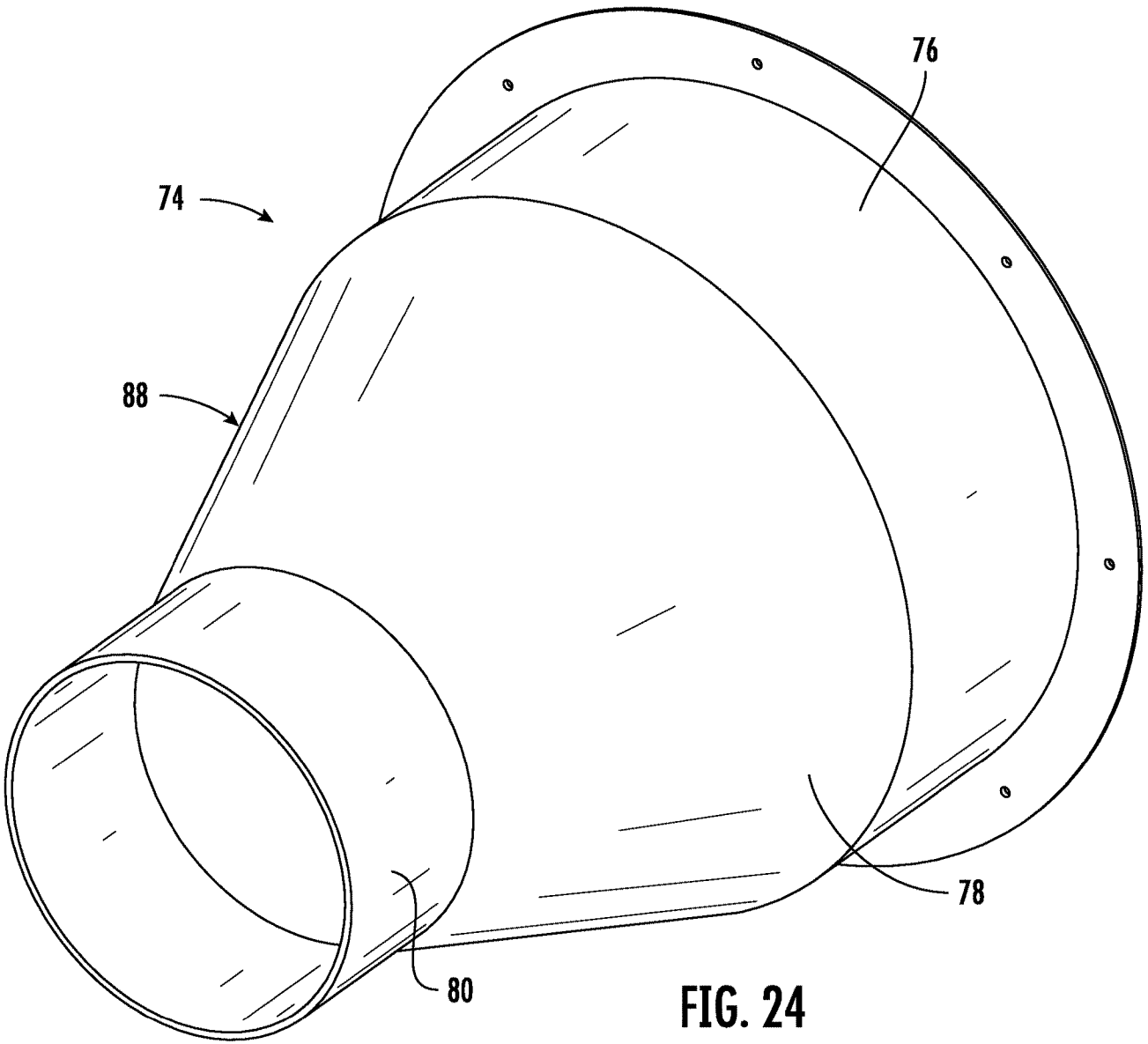
FIG. 24 is a front perspective view of the high elevation kit according to an aspect of the present disclosure.
Figure 25:
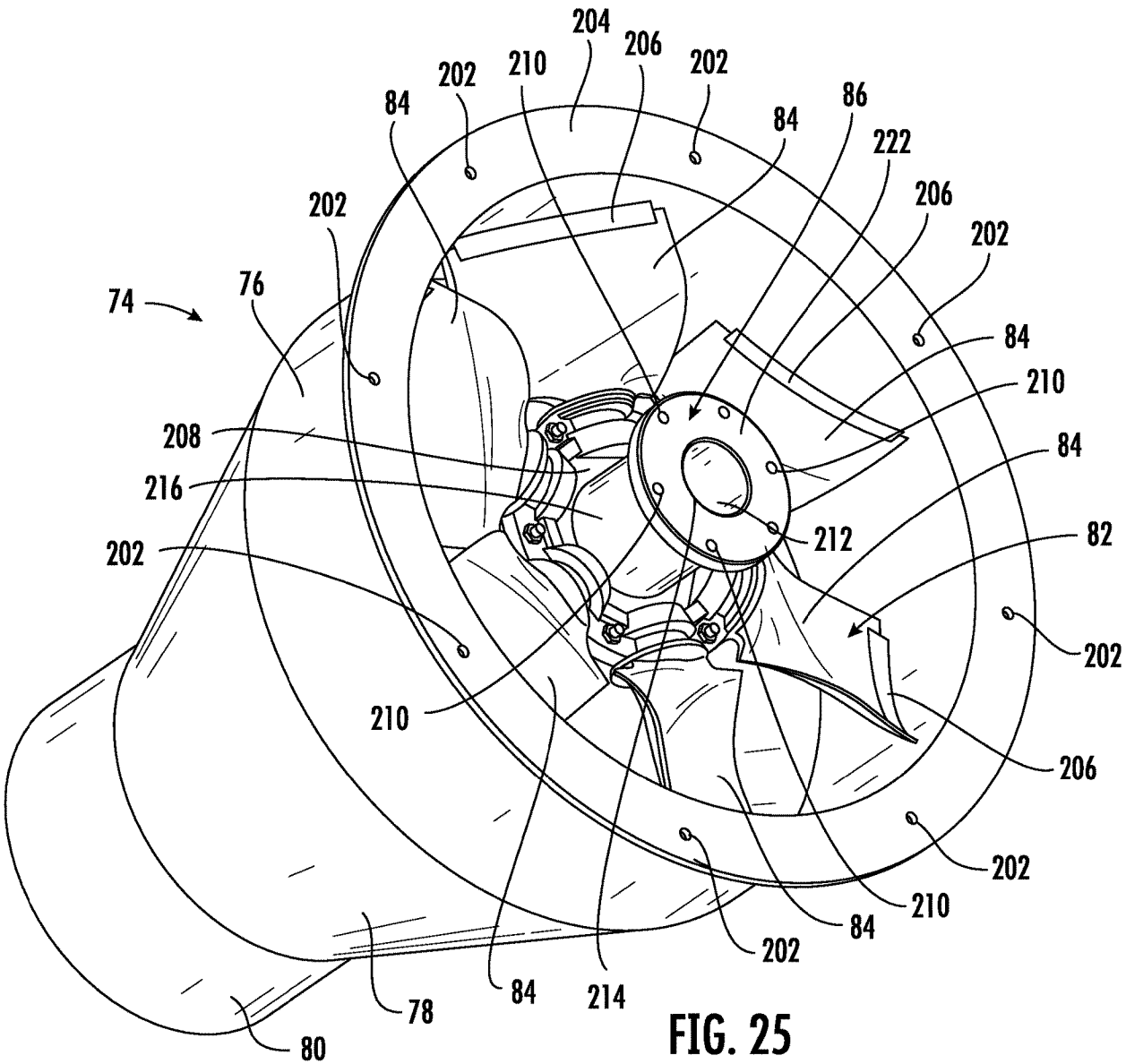
FIG. 25 is a rear perspective view of the high elevation kit with a view of the axial fan while inside of the high elevation kit according to an aspect of the present disclosure.
Figure 26:
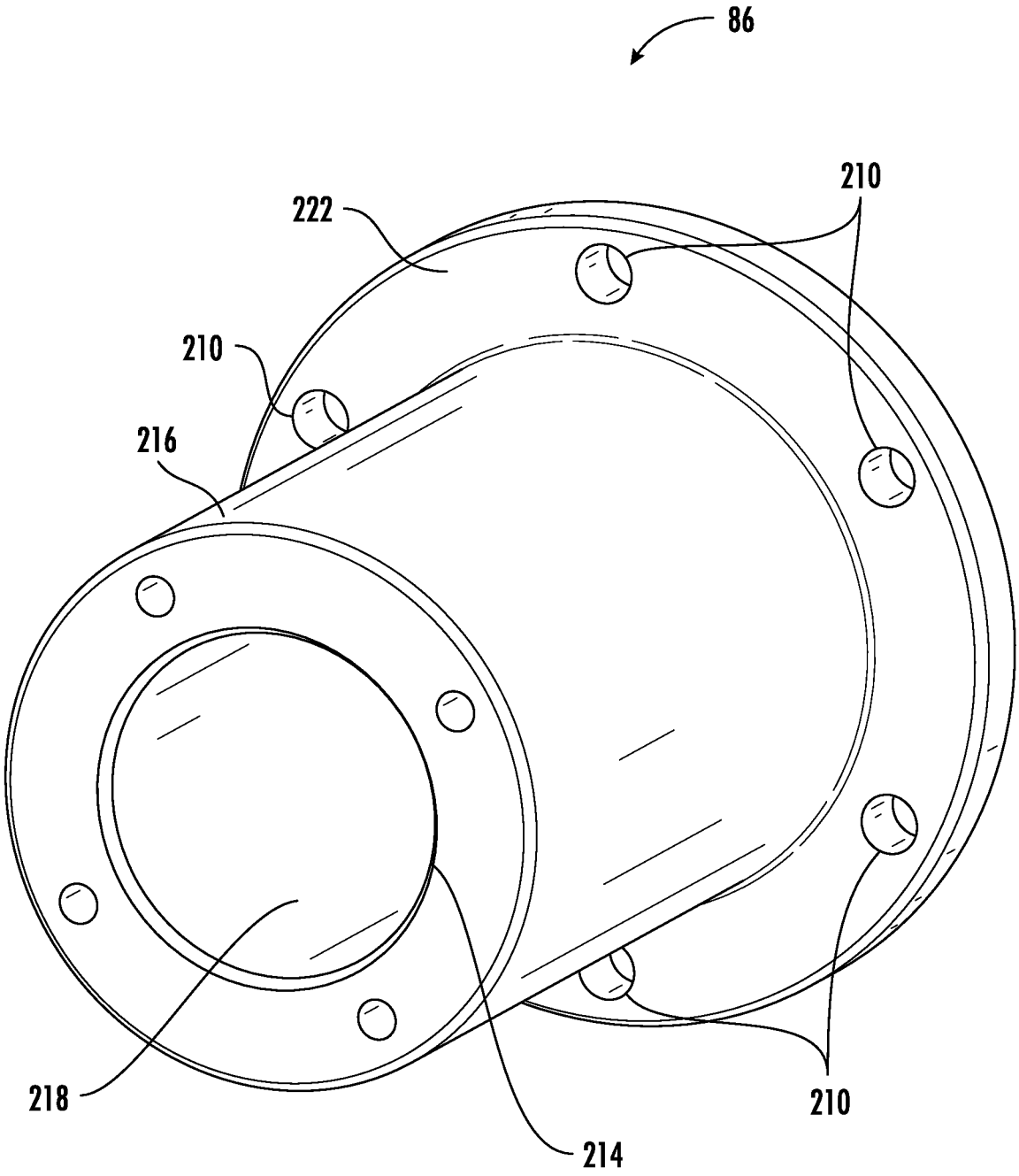
FIG. 26 is an enlarged perspective view of a central connector of the high elevation kit/assembly according to an aspect of the present disclosure.
Figure 27:
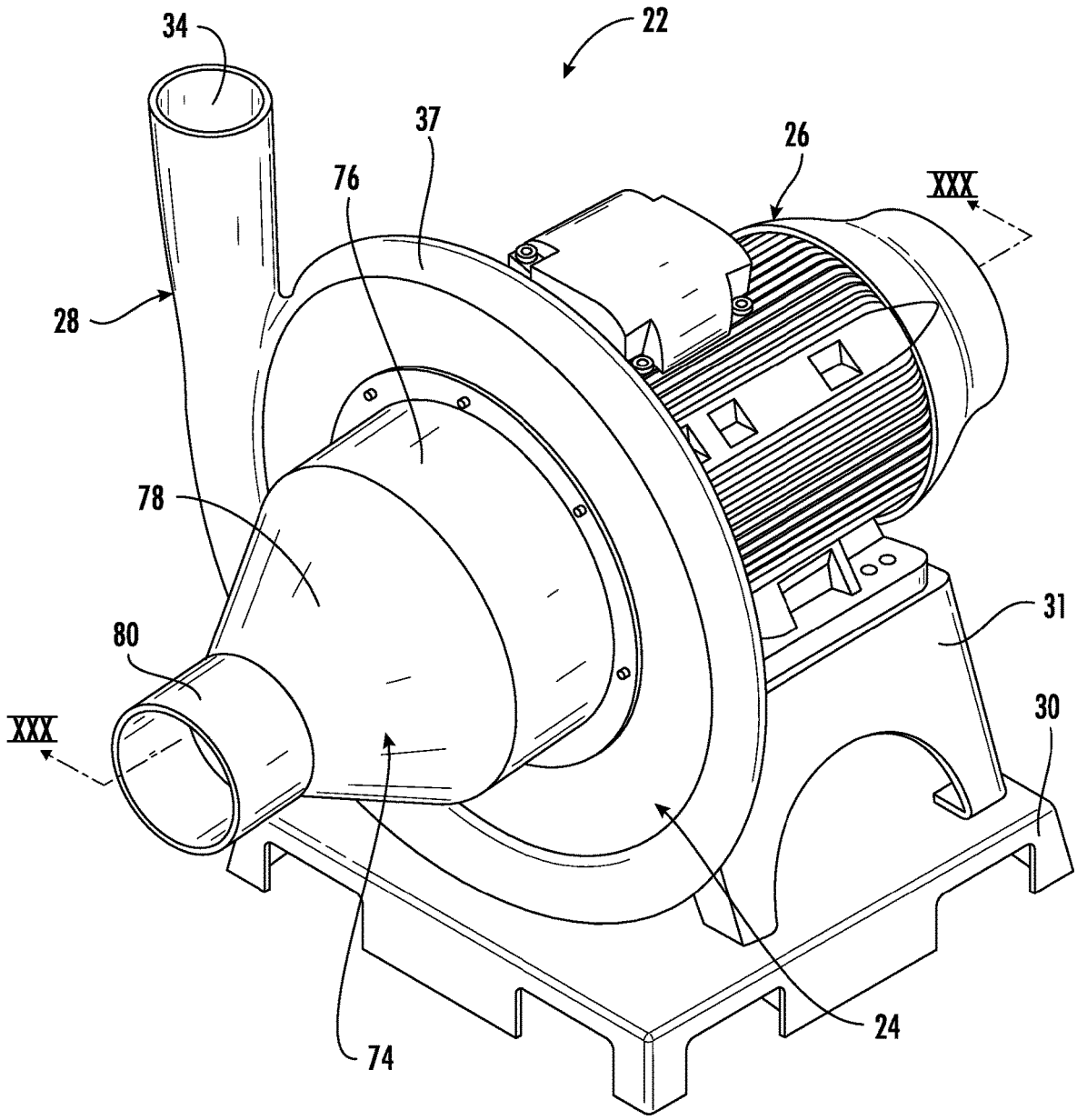
FIG. 27 is a front perspective view with the high elevation kit engaged with the overall vacuum motor assembly of the present disclosure according to an aspect of the present disclosure.
Figure 28:
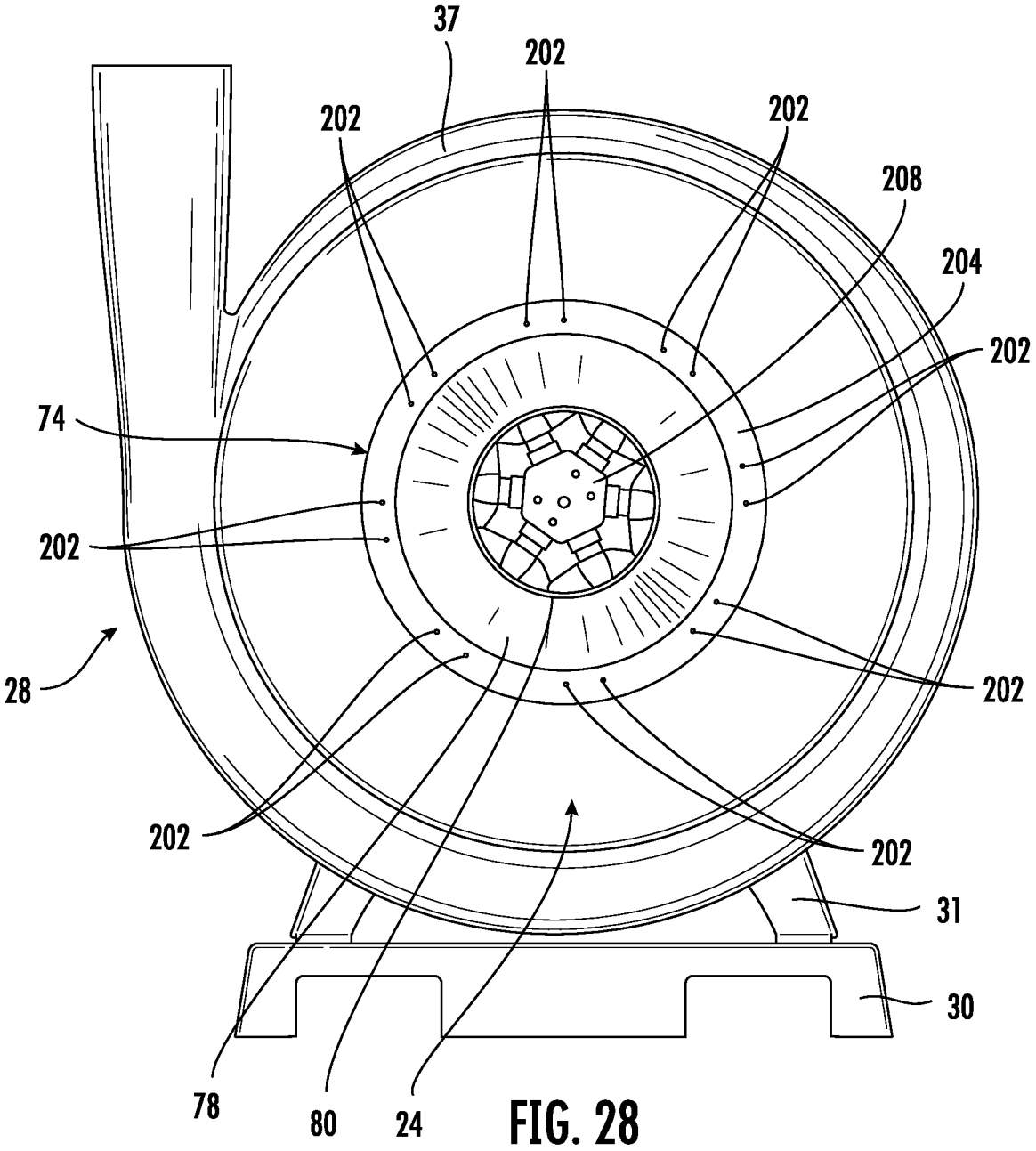
FIG. 28 is a front view of the overall vacuum motor assembly with the high elevation kit engaged to it according to an aspect of the present disclosure.
Figure 29:
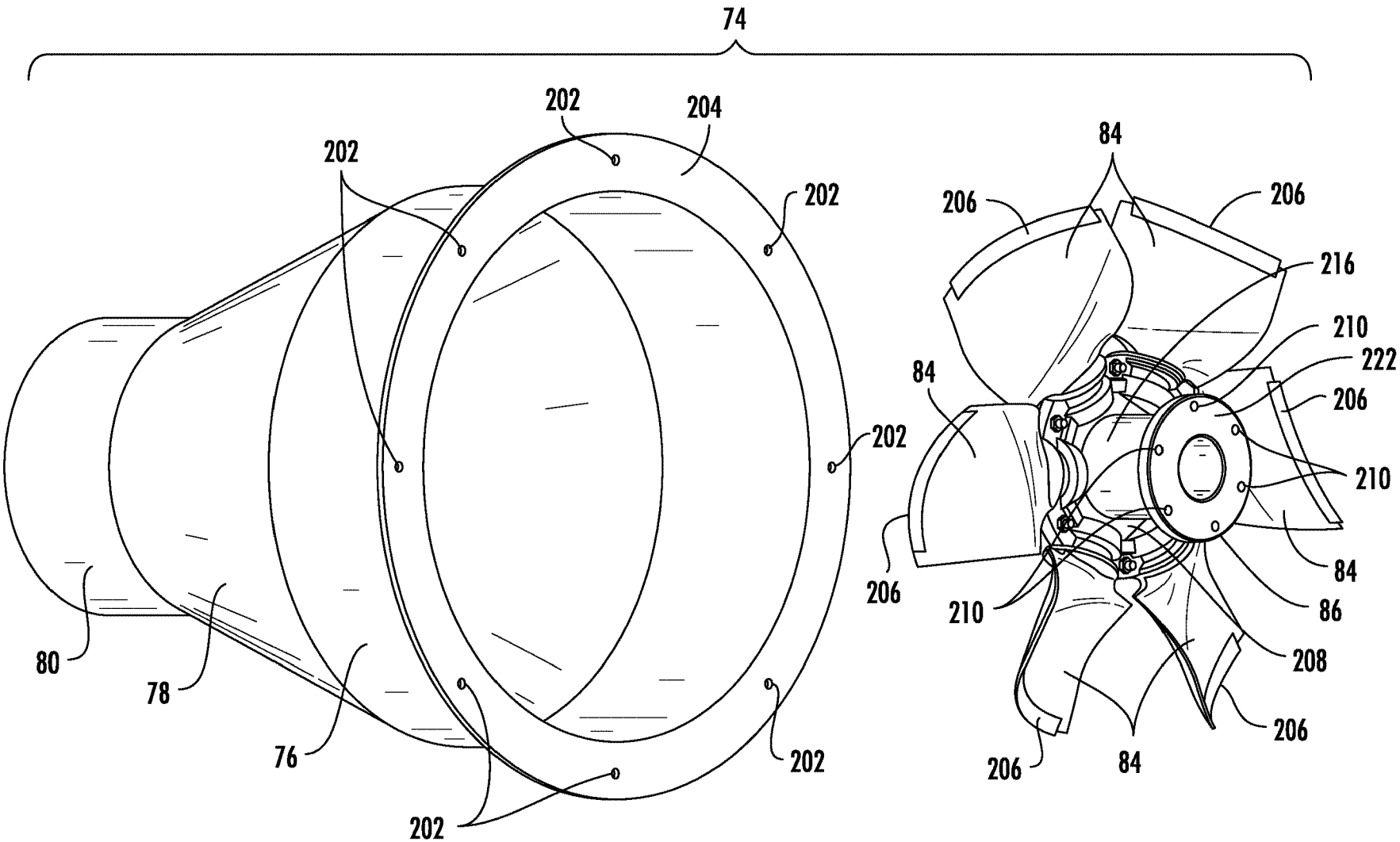
FIG. 29 is an exploded view of the high elevation kit according to an aspect of the present disclosure.
Figure 30:
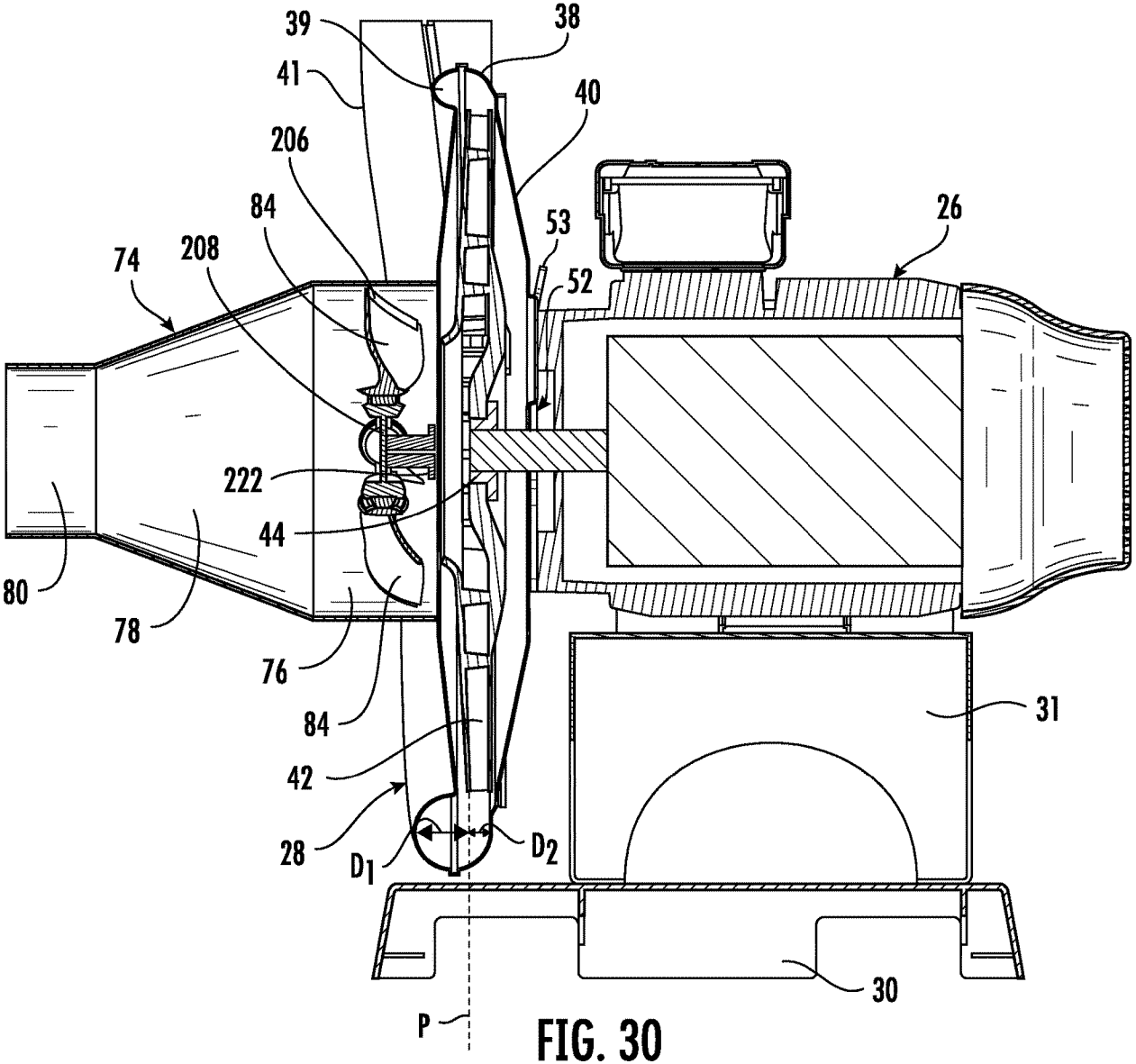
FIG. 30 is a cross sectional view of the high elevation kit attached to the vacuum motor assembly on the front end in place of the bell-shaped inlet taken along line XXX-XXX in FIG. 27 according to an aspect of the present disclosure.

Seen in FIGS. 4, 5 and 23, the vacuum pump assembly 24 typically further includes a pair of spacers 52 between the vacuum pump assembly 24 and the motor 26. The spacers 52 are used to create a small air gap to further facilitate the air movement from the thermostatic valve 50 when the valve is in the open position. The vacuum motor assembly 22 is able to cool more efficiently using these spacers thereby further protecting the vacuum motor assembly 22 from damage and wear and/or lessens the likelihood of damage or wear. The spacers 52 are typically a gently curved arch shape, but may be any shape and thickness that can allow enough air through and properly attach to the motor 26 and vacuum motor assembly 22. Conceivably, a plurality of spacers might be used and stacked on top of one another to provide added space between the motor and the rest of the vacuum motor assembly. As shown in FIGS. 9, 10, 23, and 30, the spacers 52 include an upwardly extending loop section 53 that defines an aperture 63 having an internal diameter and typically circular shape (but could be any shape such as a square or rectangle) therethrough. The loop section 53 typically reaches above the motor and does not directly physically engage the vacuum motor assembly except through its engagement with the main body portion 93 of the spacer itself. Typically, the upwardly extending loop is set an angle, typically an acute angle from the motor facing surface of the back support 40. The upwardly extending loop extends away and at an angle from the plane the main body portion of the spacer that has the two attachment apertures 107. The portion of the spacer containing the plurality of attachment apertures 107 typically defines the main body portion of the spacer. The upwardly extending loop is configured and designed to be easily grasped by a user directly by hand and without the use of tools or by the user employing a hook or hooks containing tool or other tool containing a bent portion sized to engage the aperture of the loop and move the spacer into and out of engagement. Any tool or implement that can be used to lift or otherwise move the spacer from its position by grasping or applying a force to the spacer by engagement of the aperture of the loop may be employed. It is also possible, but not preferred that a tool such as a vise-grip wrench or pliers or other grasping tool could be used, but this would not typically be the case.

Referring to FIGS. 24-30, the vacuum motor assembly 22 may include or be retrofitted with a removably attachable high elevation kit 74. In regions with a higher elevation above sea level, such as mountainous areas for example, the air is thinner. Without changing the horsepower of the motor, the vacuum motor 26 is not as efficient in these regions as it urges less air through the vacuum system. The high elevation kit, which is typically used at elevation levels of 4000 feet above sea level or greater or 5000 feet above sea level or greater, may replace and be mounted instead of the bell-shaped inlet 32 to the exterior facing surface of the front portion 36. The apertures 202 around the planar outwardly extending rim section 204 engage the apertures 200 in much the same manner as the bell-shaped inlet would typically engage them. The includes a cover portion 88 with a cylindrical downstream section 76, a conical midsection 78, and a cylindrical upstream section 80. The high elevation kit also includes an axial fan 82, which serves as an inducer to urge additional air through the vacuum motor assembly 22. The axial fan has a plurality of fan blades 84 extending radially from a fan hub 208 that are typically engaged thereto using one or a plurality of fasteners such as bolts and nut or other way of securely connecting them to one another in a manner such that the blades may be removed and replaced as needed due to wear. Each of the plurality of fan blades typically has a rubber or other elastomeric fan blade tip protective covering material 206. The fan hub 208 may be connected to or have a central connection portion 86 positioned over the exterior facing side of the fan hub 208. The central connection portion 86 (see FIGS. 25, 26, and 29) is typically attached to the drive shaft 48 as well as the fan hub 208. The central connection portion 86 is cylindrically shaped with a solid outer wall portion 216 that defines an interior 214 and is a hollow cylindrical shape. The central connection portion 86 has a first end opening 212 and a second end opening 218 such that the entire center is typically free of any obstructions and the interior and exterior walls are typically smooth. The central connection portion 86 is typically made of metal, typically a cast metal. As shown in at least FIGS. 25-26, the central connection portion also typically includes a circumferential flange 222 about its perimeter and located proximate the first end opening 212. The flange has fastener receiving apertures 210 that are typically spaced evenly along the flange, but are not necessarily evenly spaced. The fastener receiving apertures 210 are typically threaded to receive correspondingly threaded fasteners such as a bolt within each aperture 210.

To compensate for the thinner atmosphere, the impeller 42 would normally have to be changed so that it would have an increased thickness. This means that a manufacturer would need to create multiple impellers with different thicknesses to account for multiple different elevations as well as differently sized cover housings for the different impellors, which is not cost-effective. The high elevation kit/systems of the present disclosure can attach to any vacuum motor assembly 22, giving a one size fits all solution. The axial fan 82 working in conjunction with the regular impeller 42 effectively act as an impeller 42 with an increased thickness making the overall vacuum motor assembly functional at higher elevations without having to replace or change the original impeller. This removes the need for multiple vacuum pump assembly sizes, and a user only needs to attach a high elevation kit for their specific use. The pump assembly in a higher elevation will not recover 100% of the lost pressure. Typically, the pump assembly will recover between about 90% to about 91% of the original air pressure, while the high elevation kit will reclaim about 9% to about 10% of the original pressure, enabling complete pressure reclamation while working in tandem.

Figure 19:
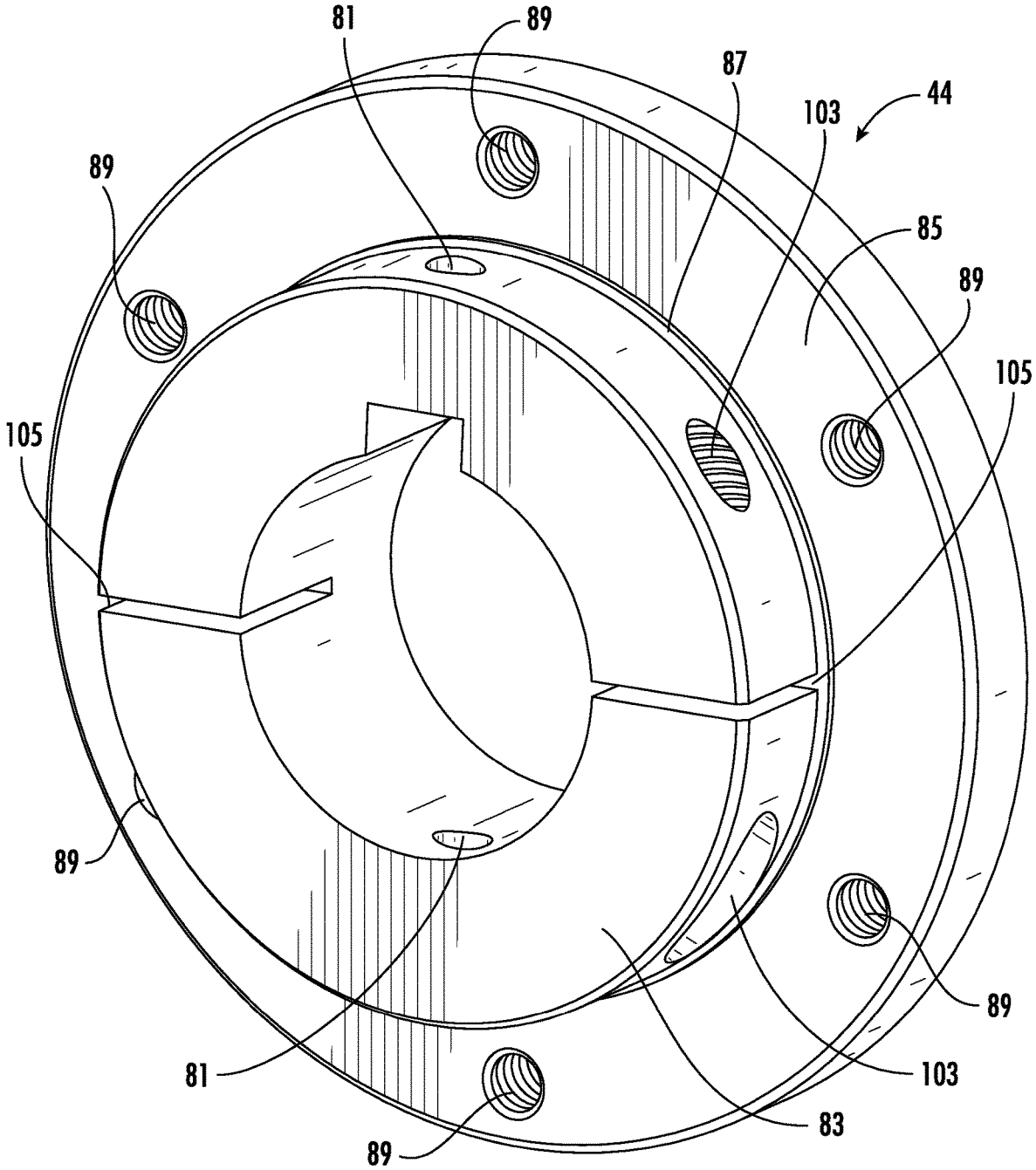
FIG. 19 is a front perspective view of a hub according to an aspect of the present disclosure.

The cover 28 portion and the inducer fan are not typically unitary. When the high elevation kit is attached to the vacuum motor assembly 22, the cover 28 portion is attached to the cover 28, while the inducer fan is attached to the same drive shaft 48 as the impeller 42. The inducer fan is enclosed within the cover portion 88 as seen in FIG. 19, but it does not directly attach to the cover portion 88, and only attaches directly to the drive shaft 48. The high elevation kit replaces the usual bell-shaped center intake pipe 32 during use, and is typically bolted to the cover 28 such that it is located over and completely covers the circular hole of the front portion 36 of the cover 28, although it could be attached via any alternative means contemplated by one of ordinary skill in the art.

The vacuum pump assembly 24 of the vacuum motor assembly 22 is typically made of aluminum that is molded to the proper shape by die casting. The vacuum pump assembly 24 could employ other metals such as steel or titanium. However, aluminum was found to be more beneficial for its weight. Given the size of the vacuum pump assembly 24 and the impeller 42 within, some metals may be used in an amount that is too heavy to ship or transport as a practical/economic matter to remote locations from the location where the motor is produced. Aluminum is both durable enough for use and light enough to avoid significant issues and costs when components made with it are shipped to customer's locations.

What is claimed is:

1. A vacuum motor assembly for providing vacuum suction power to one or more vehicle vacuuming locations in a vehicle washing and vacuuming facility, wherein the vacuum motor assembly comprises:

a motor comprising a drive shaft;

a closed impeller having a front shroud and a back shroud, with a plurality of impeller blades spaced radially around a center portion of the closed impeller between the front shroud and the back shroud, wherein the closed impeller has an impeller diameter and wherein the center portion is free of any of the plurality of impeller blades and the plurality of impeller blades are circumjacent the center portion of the closed impeller;

an impeller cover spaced around the closed impeller, wherein the impeller cover comprises:

a front portion having a front portion central opening defined by an inner perimeter edge; a front portion inner surface; a forwardly extended channel section between the inner perimeter edge and a front portion outer perimeter edge, wherein the front portion outer perimeter edge extends away from the front portion inner surface toward the closed impeller; and a front portion air exhaust chute section that is tapered;

a back portion engaged to the front portion, wherein the back portion has front portion facing side and a back support facing side, a back portion inner surface, a back portion air exhaust chute section that matingly engages the front portion air exhaust chute section and is tapered, an interior edge having an interior edge perimeter that defines a back portion opening that is larger than the closed impeller, and an outer perimeter edge engaged with the front portion outer perimeter edge to collectively form a spiral shaped airflow channel located about a perimeter of the impeller cover, wherein the spiral-shaped airflow channel starts with a tapered end, extends around the impeller cover, and then into an air exhaust outlet formed by engagement of the front portion air exhaust chute section and the back portion air exhaust chute section together; and wherein a cross sectional area of the spiral shaped airflow channel between the front portion and the back portion increases from the tapered end to the air exhaust outlet;

wherein a front surface of the front shroud of the closed impeller defines a vertical plane and a first air channel interior distance from the front portion inner surface to the vertical plane within the spiral-shaped airflow channel is greater than a second air channel interior distance from the back portion inner surface to the vertical plane; and a back support having a back support perimeter, a concave side and a convex side, wherein the concave side of the back support is engaged with the back support facing side of the back portion around the back portion opening such that the back support covers substantially all of the back portion opening, and wherein the convex side is engaged with the motor, wherein the back support includes a drive shaft receiving aperture; wherein when the back portion is fixedly engaged to the motor, and wherein the drive shaft passes through the drive shaft receiving aperture of the back support and engages the closed impeller.

2. The vacuum motor assembly of claim 1, wherein the motor further comprises at least one fastener receiving hole configured to and oriented to receive a fastener engaged with the back support and wherein the back support is engaged with the at least one fastener receiving hole of an attachment system using at least one fastener that passes through the back support and into engagement with the at least one fastener receiving hole.

3. The vacuum motor assembly of claim 2, wherein the motor further comprises the attachment system, the attachment system is positioned circumjacent the drive shaft, and the attachment system comprises the at least one fastener receiving hole configured to and oriented to receive the fastener engaged with the back support, and wherein the at least one fastener receiving hole is a plurality of substantially evenly spaced apart fastener receiving holes each configured to and oriented to receive a fastener engaged with the back support.

4. The vacuum motor assembly of claim 2 further comprising one or more spacers disposed between and engaged with the back support and the at least one fastener receiving hole of the attachment system, such that there is an extended space between the back support and the motor where air can pass freely.

5. The vacuum motor assembly of claim 1 further comprising a thermostatic valve engaged with the back support such that when an elevated temperature is reached the thermostatic valve opens to provide an air channel between a volume of air inside the vacuum motor assembly and a volume of air outside the vacuum motor assembly.

6. The vacuum motor assembly of claim 5, wherein the thermostatic valve comprises:

a wax motor operably engaged with a vertical piston, the wax motor containing a volume of wax that expands when exposed to heat to melt the volume of wax and contracts when the volume of wax cools thereby contracting the volume of wax into a contracted state, and wherein the vertical piston extends when the volume of wax expands and the vertical piston retracts when the volume of wax contracts; and a bridge piece engaged with the vertical piston such that the bridge piece is biased between a valve door open position and a valve door closed position and the bridge piece conveys a valve door opening force to a valve door to open the valve door when the volume of wax expands and wherein the valve door is spring biased such that an airflow channel is covered by the valve door when the volume of wax is in its contracted state.

7. The vacuum motor assembly of claim 6, wherein the thermostatic valve is engaged to a mounting framework that comprises a recessed back wall and at least one upwardly extending side wall that together define a recessed space wherein the thermostatic valve is spaced within the recessed space and wherein the mounting framework further comprises a perimeter rim around the perimeter of the mounting framework such that the perimeter rim engages the front portion facing side of the back support and is affixed thereto using a plurality of mounting framework fasteners that engage the back support with the mounting framework through a plurality of spaced apart apertures within the perimeter rim and the recessed back wall.

8. The vacuum motor assembly of claim 1, wherein the closed impeller does not contact the front portion inner surface, the back portion inner surface, or the concave side of the back support during use and wherein the front portion is permanently affixed to the back portion by a welded connection and wherein the back portion opening has a circular shape.

9. The vacuum motor assembly of claim 1 further comprising an inlet pipe having an upstream end and a downstream end, wherein the downstream end is removably engaged to the front portion around the inner perimeter edge and over the front portion central opening using a plurality of spaced apart fasteners circumjacent a perimeter portion of the downstream end, and wherein the downstream end has a diameter that is greater than a diameter of the upstream end and the upstream end and the downstream end have an airflow pathway between the upstream end and the downstream end wherein the airflow pathway is a direct pathway between the downstream end and the upstream end.

10. The vacuum motor assembly of claim 1 further comprising a high elevation adaption kit engaged with the front portion and configured to increase the vacuum power at physical locations at above 4000 feet above sea level or greater, wherein the high elevation adaption kit comprises:

an air inlet pipe having a cylindrically-shaped upstream end having an upstream end diameter, a cylindrically-shaped downstream end having a downstream end diameter, and a midsection interconnected with both the cylindrically-shaped upstream end and the cylindrically-shaped downstream end to establish a high elevation kit airflow pathway extending from the air inlet pipe to a downstream end outlet, and wherein the upstream end diameter is less than the downstream end diameter;

a fan having a central hub and a plurality of fan blades engaged with the central hub and arranged radially around the central hub;

wherein the cylindrically-shaped downstream end of the air inlet pipe is engaged to the front portion of the impeller cover about the inner perimeter edge; and wherein the central hub is engaged to the drive shaft with a cylindrical connecting piece and the fan is positioned inside the cylindrically-shaped downstream end of the air inlet pipe.

11. The vacuum motor assembly of claim 1, wherein the closed impeller includes a plurality of struts on a rear facing side of the back shroud and extending radially on the rear facing side of the back shroud and either integrally formed with the back shroud or fixedly connected thereto via a welded connection and wherein the plurality of struts each reinforce the closed impeller and prevent the closed impeller from warping.

12. A vacuum motor assembly comprising:

a motor comprising a drive shaft;

an impeller having a plurality of impeller blades spaced radially around a center portion of the impeller wherein the impeller has an impeller diameter and wherein the center portion is free of any of the plurality of impeller blades and the plurality of impeller blades are circumjacent the center portion of the impeller;

an impeller cover spaced around the impeller wherein the impeller cover comprises:

a front portion having a front portion central opening defined by an inner perimeter edge; a front portion inner surface; a forwardly extended channel section between the inner perimeter edge and a front portion outer perimeter edge, wherein the front portion outer perimeter edge extends away from the front portion inner surface toward the impeller; and a front portion air exhaust chute section;

a back portion engaged to the front portion, wherein the back portion has front portion facing side and a back support facing side, a back portion inner surface, a back portion air exhaust chute section, an interior edge having an interior edge perimeter that defines a back portion opening that is larger than the impeller, and an outer perimeter edge engaged with the front portion outer perimeter edge to collectively form a spiral shaped airflow channel located about a perimeter of the impeller cover, wherein the spiral-shaped airflow channel starts with a tapered end, extends around the impeller cover, and then into an air exhaust outlet formed by engagement of the front portion air exhaust chute section and the back portion air exhaust chute section together;

wherein a front surface of the impeller defines a vertical plane and a first air channel interior distance from the front portion inner surface to the vertical plane within the spiral-shaped airflow channel is greater than a second air channel interior distance from the back portion inner surface to the vertical plane; and a back support having a back support perimeter, a motor-facing side and an impeller-facing side, wherein the impeller-facing side of the back support is engaged with the back support facing side of the back portion around the back portion opening such that the back support covers the back portion opening, wherein the motor-facing side is engaged with the motor, wherein the back support further comprises a drive shaft receiving aperture; wherein when the back support is fixedly engaged to the motor; and wherein the drive shaft passes through the drive shaft receiving aperture of the back support and engages with the impeller.

13. The vacuum motor assembly of claim 12, wherein the impeller is a single closed impeller having a front shroud and a back shroud with a plurality of impeller blades spaced radially around the center portion of the impeller between the front shroud and the back shroud, wherein the impeller has an impeller diameter and wherein the center portion is free of any of the plurality of impeller blades and the center portion is circumjacent a center of the impeller.

14. The vacuum motor assembly of claim 13, wherein the impeller includes a plurality of struts on a rear facing side of the back shroud and extending radially on the rear facing side of the back shroud and either integrally formed with the back shroud or fixedly connected thereto via a welded connection and wherein the plurality of struts each reinforce the impeller.

15. The vacuum motor assembly of claim 12, wherein the impeller-facing side of the back support is concave and the motor-facing side is convex and wherein the front portion air exhaust chute section and the back portion air exhaust chute section matingly engages the front portion air exhaust chute section thereby forming an air exhaust chute that is tapered with an air exhaust chute outlet end that is wider than an opposite end of the air exhaust chute.

16. The vacuum motor assembly of claim 12 further comprising a thermostatic valve disposed between the impeller-facing side of the back support and the impeller.

17. The vacuum motor assembly of claim 12 further comprising a thermostatic valve engaged to a mounting framework that comprises a recessed back wall and at least one upwardly extending side wall that together define a recessed space wherein the thermostatic valve is spaced within the recessed space and wherein the mounting framework further comprises a perimeter rim around the perimeter of the mounting framework such that the perimeter rim engages the front portion facing side of the back support and is affixed thereto using a plurality of mounting framework fasteners that engage the back support with the mounting framework through a plurality of spaced apart apertures within the perimeter rim and the recessed back wall.

18. The vacuum motor assembly of claim 12, wherein a cross sectional area of the spiral shaped airflow channel between the front portion and the back portion increases along the spiral-shaped airflow channel from the tapered end to the air exhaust outlet; and wherein the vacuum motor assembly further comprises further an inlet pipe having an upstream end and a downstream end, wherein the downstream end is removably engaged to the front portion around the inner perimeter edge and over the front portion central opening using a plurality of spaced apart fasteners circumjacent a perimeter portion of the downstream end, and wherein the downstream end has a diameter that is greater than a diameter of the upstream end and the upstream end and the downstream end have an airflow pathway between the upstream end and the downstream end, wherein the airflow pathway is a direct pathway between the downstream end and the upstream end.

19. A method of replacing a component of a vacuum motor assembly without removing an impeller of the vacuum motor assembly from engagement with an impeller, the method comprising the steps of:

disengaging a first back support from engagement with a first impeller cover spaced around the impeller, wherein the first impeller cover comprises:

a front portion having a front portion central opening defined by an inner perimeter edge; a front portion inner surface; a forwardly extended channel section between the inner perimeter edge and a front portion outer perimeter edge, wherein the front portion outer perimeter edge extends away from the front portion inner surface toward the impeller; and a front portion air exhaust chute section;

a back portion engaged to the front portion, wherein the back portion has front portion facing side and a back support facing side, a back portion inner surface, a back portion air exhaust chute section, an interior edge having an interior edge perimeter that defines a back portion opening that is larger than the impeller, and an outer perimeter edge engaged with the front portion outer perimeter edge to collectively form a spiral shaped airflow channel located about a perimeter of the first impeller cover, wherein the spiral-shaped airflow channel starts with a tapered end, extends around the first impeller cover, and then into an air exhaust outlet formed by the engagement of the front portion air exhaust chute section and the back portion air exhaust chute section together;

wherein the first back support has a first back support perimeter, a motor-facing side and an impeller-facing side, wherein the impeller-facing side of the first back support is engaged with the back support facing side of the back portion around the back portion opening such that the first back support covers the back portion opening of the first impeller cover, and wherein the motor-facing side is engaged with a motor, wherein the first back support further comprises a drive shaft receiving aperture; and wherein when the first back support is fixedly engaged to the motor a drive shaft of the motor passes through the drive shaft receiving aperture of the back support and engages with the impeller that is positioned between within the first impeller cover; and replacing either or both of (1) all or a portion of the first impeller cover with all or a portion of a second impeller cover or (2) the first back support with a second back support; wherein the second impeller cover comprises:

a front portion having a front portion central opening defined by an inner perimeter edge; a front portion inner surface; a forwardly extended channel section between the inner perimeter edge and a front portion outer perimeter edge, wherein the front portion outer perimeter edge extends away from the front portion inner surface toward the impeller; and a front portion air exhaust chute section;

a back portion engaged to the front portion, wherein the back portion has front portion facing side and a back support facing side, a back portion inner surface, a back portion air exhaust chute section, an interior edge having an interior edge perimeter that defines a back portion opening that is larger than the impeller, and an outer perimeter edge engaged with the front portion outer perimeter edge to collectively form a spiral shaped airflow channel located about a perimeter of the first impeller cover, wherein the spiral-shaped airflow channel starts with a tapered end, extends around the first impeller cover, and then into the air exhaust outlet formed by the engagement of the front portion air exhaust chute section and the back portion air exhaust chute section together;

wherein the second back support has a second back support perimeter, the motor-facing side and an impeller-facing side, wherein the impeller-facing side of the second back support is engaged with the back support facing side of the back portion around the back portion opening such that the back support covers the back portion opening, and wherein the motor-facing side is engaged with a motor, wherein the first back support further comprises a drive shaft receiving aperture; and wherein when the first back support is fixedly engaged to the motor a drive shaft of the motor passes through the drive shaft receiving aperture of the back support and engages with the impeller that is positioned between within the second impeller cover;

wherein a front surface of the impeller defines a vertical plane and a first air channel interior distance from the front portion inner surface to the vertical plane within the spiral-shaped airflow channel is greater than a second air channel interior distance from the back portion inner surface to the vertical plane; and wherein the impeller has a plurality of impeller blades spaced radially around a center portion of the impeller wherein the impeller has an impeller diameter and wherein the center portion is free of any of the plurality of impeller blades and the plurality of impeller blades are circumjacent the center portion of the impeller.

20. The method of claim 19, wherein the method is done, on site, at a vehicle cleaning location and not shipped to a vacuum motor assembly provider or a motor servicing location and wherein the step of replacing either or both of (1) all or a portion of the first impeller cover with all or a portion of a second impeller cover or (2) the first back support with a second back support does not include disengaging the drive shaft from the impeller or the first back support from engagement with the motor;

wherein the back portion of the back portion of the first impeller cover and the back portion of the second impeller cover each have a plurality of fastening bolts having a threaded portion extending away from the impeller, with the plurality of fastening bolts spaced at even intervals around the interior edge, and wherein the threaded portions pass through a plurality of corresponding receiving holes spaced around a perimeter of the first back support and are secured on an opposite side of the back support by tightening nuts; and wherein the method the step of removing the tightening nuts from the threaded portion of each of the plurality of fastening bolts.

* * * * *